US008348699B2

(12) United States Patent
Nagawatari et al.

(10) Patent No.: US 8,348,699 B2
(45) Date of Patent: Jan. 8, 2013

(54) ELECTRICAL CONNECTOR AND METHOD OF CONNECTING TWISTED PAIR CABLE TO THE ELECTRICAL CONNECTOR

(75) Inventors: Takashi Nagawatari, Tokyo (JP); Naohisa Nakata, Tokyo (JP); Tadashi Kubota, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 13/154,604

(22) Filed: Jun. 7, 2011

(65) Prior Publication Data

US 2011/0300750 A1 Dec. 8, 2011

(30) Foreign Application Priority Data

Jun. 8, 2010 (JP) ..... 2010-131262
Sep. 30, 2010 (JP) ..... 2010-220633

(51) Int. Cl.
*H01R 13/648* (2006.01)

(52) U.S. Cl. ..... 439/607.01

(58) Field of Classification Search ..... 439/607.01, 439/607.05, 607.12, 607.15, 607.41
See application file for complete search history.

(56) References Cited

U.S. PATENT DOCUMENTS

| | | | | |
|---|---|---|---|---|
| 4,592,612 | A | 6/1986 | Kikuta | |
| 4,702,538 | A * | 10/1987 | Hutter et al. | 439/292 |
| 4,786,260 | A * | 11/1988 | Spaulding | 439/607.01 |
| 5,244,415 | A | 9/1993 | Marsilio et al. | |
| 5,571,035 | A * | 11/1996 | Ferrill | 439/894 |
| 6,017,238 | A * | 1/2000 | Johnston | 439/404 |
| 6,676,444 | B2 * | 1/2004 | Noro | 439/579 |
| 6,722,898 | B2 * | 4/2004 | Peloza et al. | 439/108 |
| 6,827,600 | B2 * | 12/2004 | Negishi et al. | 439/404 |
| RE39,380 | E * | 11/2006 | Davis | 439/660 |
| 7,494,348 | B1 * | 2/2009 | Tyler et al. | 439/79 |
| 7,601,029 | B2 * | 10/2009 | Horiuchi et al. | 439/607.01 |
| 7,722,410 | B2 * | 5/2010 | De Dios Martin et al. | 439/676 |
| 7,909,647 | B2 * | 3/2011 | Kawaguchi et al. | 439/585 |
| 8,057,258 | B2 * | 11/2011 | Kawaguchi et al. | 439/585 |
| 2006/0035522 | A1 | 2/2006 | Kuroda et al. | |
| 2009/0068890 | A1 * | 3/2009 | Horiuchi et al. | 439/610 |
| 2010/0081302 | A1 | 4/2010 | Atkinson et al. | |

FOREIGN PATENT DOCUMENTS

| | | |
|---|---|---|
| EP | 1950847 A2 | 7/2008 |
| JP | 2004-071404 | 3/2004 |

OTHER PUBLICATIONS

Extended European Search Report for European Patent Application 11004663.8, European Patent Office, Sep. 6, 2011.

* cited by examiner

*Primary Examiner* — Amy Cohen Johnson
*Assistant Examiner* — Vladimir Imas
(74) *Attorney, Agent, or Firm* — Kubotera & Associates, LLC

(57) ABSTRACT

An electrical connector includes a connector main body made of an insulating material for attaching an end portion of a pair of single wires untwisted at an end portion of a twisted pair cable; and a shell member to hold the untwisted portion. The shell member includes a base portion made of a conductive material to dispose the connector main body at the front end side and the untwisted portion at the basal end side; a cable holding portion made of a conductive material to hold the single wires at the untwisted portion for positioning the single wires parallel to each other and close or contact to each other; and a cover portion provided on the base portion to have at least the untwisted portion and the cable holding portion between the cover portion and base portion.

15 Claims, 10 Drawing Sheets

ELECTRICAL CONNECTOR AND METHOD OF CONNECTING TWISTED PAIR CABLE TO THE ELECTRICAL CONNECTOR

BACKGROUND OF THE INVENTION AND RELATED ART STATEMENT

The present invention relates to an electrical connector to be connected to a twisted pair cable and a method of connecting a twisted pair cable to the electrical connector.

In general, there are two types of twisted pair cable, i.e., an unshielded twisted pair cable (UTP) and a shielded twisted pair cable (STP). The unshielded twisted pair cable is a cable made by twisting a pair of single wires. As compared with a simple parallel cable, the unshielded twisted pair cable is not susceptible to noises from outside and has good noise performance with less noise radiation. Further, the unshielded twisted pair cable is easy to handle and reasonable priced. Accordingly, the unshielded twisted pair has been widely used. However, the unshielded twisted pair cable does not have excellent noise performance in comparison with a coaxial cable. For this reason, the shielded twisted pair cable, which is made by twisting a pair of single wires and coated with a conductive shield so as to improve the noise performance, has also been widely used.

When a conventional electrical connector is connected to an end portion of the unshielded twisted pair cable, end parts of a pair of single wires of the unshielded twisted pair cable are connected to a plurality of terminals of the electrical connector. The terminals are disposed within a housing of the conventional electrical connector, and are arranged away from each other with a specific positional relationship. For this purpose, it is necessary to untwist the pair of single wires at the end portion of the unshielded twisted pair cable. As a result, although the unshielded twisted pair cable has specific characteristic impedance at a high frequency when the pair of single wires is twisted, the specific characteristic impedance tends to increase at a portion where the pair of single wires is untwisted.

In addition, in case of the shielded twisted pair cable, the single wires are untwisted after removing a conductive shield at the end parts to expose the pair of single wires. As a result, although the shielded twisted pair cable has specific characteristic impedance at a high frequency when the pair of single wires is twisted, the specific characteristic impedance tends to increase at a portion where the pair of single wires is untwisted.

As described above, when the single wires are untwisted or the conductive shield is removed, the impedance tends to increase at the portion where the twisted pair cable is untwisted. Accordingly, it is difficult to achieve impedance matching between circuits or devices, which are connected via the conventional electrical connector and the twisted pair cable.

Furthermore, when the single wires are untwisted or the conductive shield is removed, initial noise performance of the twisted pair cable tends decrease at the end portion of the twisted pair cable connected to the conventional electrical connector.

Patent Reference has disclosed a method of adjusting impedance of the twisted pair cable. According to Patent Reference, a pair of untwisted single wires is bundled with a tape or a tube at an untwisted portion of the twisted pair cable.

Patent Reference: Japanese Patent Application Publication No. 2004-71404

According to Patent Reference, in case of a small-sized electrical connector or in case of connecting a plurality of twisted pair cable (a plurality of paired wires) to one electrical connector at small intervals, it is not easy to bundle the untwisted pair of single wires with the tape or the tube. As a result, according to the technique described in Patent Reference, it is difficult to connect the conventional electrical connector to the twisted pair cable in a simple procedure, and it is necessary to take more time for the connection work. Further, it may result in poor yield due to poor attachment of the tape or the tube.

In view of the above-described problems, an object of an invention is to provide an electrical connector and a method of connecting a twisted pair cable to the electrical connector. In the present invention, it is possible to control impedance and maintain noise performance of the twisted pair cable, especially at an untwisted portion of a shielded twisted pair cable. Further, it is possible to easily or securely connect the twisted pair cable to the electrical connector.

Further objects and advantages of the invention will be apparent from the following description of the invention.

SUMMARY OF THE INVENTION

In order to solve the above problems, according to a first aspect of the present invention, an electrical connector is for connecting to an end portion of a twisted pair cable, which is made by twisting a pair of single wires, each of which respectively includes a conductor and an insulator that coats the conductor.

According to the first aspect of the present invention, the electrical connector includes a connector main body, which is made of an insulating material, for attaching an end portion of each single wire of the untwisted pair of single wires that are untwisted at the end portion of the twisted pair cable; and a shell member to hold the untwisted portion, which is a portion of the pair of single wires that are untwisted at an end portion of the twisted pair cable.

According to the first aspect of the present invention, the shell member includes a base portion, which is made of a conductive material, to dispose the connector main body at the front end side and the untwisted portion at the basal end side; a cable holding portion, which is made of a conductive material, to hold the pair of single wires at the untwisted portion that is disposed at the basal end section of the base portion while positioning single wires of the pair so as to parallel to each other and close or contact to each other; and a cover portion provided on the base portion so as to have at least the untwisted portion and the cable holding portion between the cover portion and base portion.

According to the first aspect of the present invention, electrical connector of the invention, the cable holding portion holds the untwisted portion of the twisted pair cable and positions the single wires of the pair at the untwisted portion so as to be parallel to each other and close or contact to each other. With the configuration, it is possible to reduce impedance at the untwisted portion, and thereby achieve impedance matching between circuits or devices that are connected via the electrical connector and twisted pair cable.

Furthermore, both the base portion and the cable holding portion are formed of the conductive material. Accordingly, it is possible to cover the untwisted portion with a conductive material. With the configuration, if the conductive material is grounded, it is possible to further reduce the impedance at the untwisted portion, and thereby more effectively achieve impedance matching between circuits or devices that are connected via the electrical connector and the twisted pair cable. Moreover, with the configurations, it is possible to control the decrease of the noise performances originally owned by the twisted pair cable at the end portion of the twisted pair cable connected to the electrical connector.

According to a second aspect of the present invention, the electrical connector in the first aspect of the present invention may be characterized by that the cable holding portion completely or partially covers periphery of the pair of single wires at the untwisted portion.

With the configuration, it is possible to further reduce the impedance at the untwisted portion, and even more effectively achieve the impedance matching between the circuits or devices that are connected via the electrical connector and the twisted pair cable.

According to a third aspect of the present invention, the electrical connector in the first aspect or the second aspect may be characterized by that the cable holding portion continuously covers the untwisted section from the basal part of the base portion up to a position so as to reach the connector main body or get close thereto.

With the configuration, it is possible to further reduce the impedance at the untwisted portion, and thereby even more effectively achieve the impedance matching between the circuits or devices that are connected via the electrical connector or the twisted pair cable.

According to a fourth aspect of the present invention the electrical connector in one of the first through third aspects may be characterized by that the cable holding portion is formed by attaching a conductive member, which is independent from the base portion, to the base portion.

With the configuration, it is possible to easily achieve a configuration to hold the untwisted portion by the cable holding portion.

According to a fifth aspect of the present invention, the electrical connector in the fourth aspect may be characterized by having at least a pair of protrusions that protrudes from the base portion so as to interpose both sides of the untwisted section therebetween and positions the pair of single wires at the untwisted portion onto the base portion. The conductive member is attached to the base portion or the pair of protrusions so as to link between the pair of protrusions.

With the configuration, by disposing the pair of single wires of the untwisted portion between the pair of protrusions, it is possible to easily make a configuration to hold the untwisted portion by attaching the conductive member to the base portion after positioning the pair of single wires on the base portion. Therefore, it is possible to enhance the workability upon connecting the electrical connector to the twisted pair cable, make the connecting work easy, and enhance the reliability of the connecting work.

According to a sixth aspect of the present invention, the electrical connector in the fourth aspect or the fifth aspect may be characterized by that the cover portion has a pressing section to press the conductive member between the cover portion and the base portion.

With the configuration, it is possible to securely keep holding of the untwisted portion. In addition, by imparting a function of pressing the conductive member to the cover portion, it is possible to reduce the number of members required for holding the untwisted portion.

According to a seventh aspect of the present invention, the electrical connector in one of the first through the third aspects may be characterized by making the cable holding portion by cutting and bending a part of the base portion.

With the configuration, it is possible to reduce the number of members necessary for holding the untwisted portion.

According to an eighth aspect of the present invention, the electrical connector in one of the first through the third aspects may be characterized by forming the whole or a part of the cover portion from a conductive material and making the cable holding portion by attaching the cover portion to the base portion so as to cover at least an upper part of the untwisted portion at a portion of the cover portion that is made of a conductive material.

More specifically, if the whole cover is made of a conductive material, the configuration is preferably the one to cover at least the upper part of the untwisted section by attaching the cover portion to the base portion. In addition, if the whole cover portion is not made of a conductive material, it is also possible to configure to cover at least the upper part of the untwisted portion by a portion of the cover portion that is made of the conductive material. Since it is possible to achieve the cable holding portion using the cover portion in any of the above-described configurations, it is possible to reduce the number of members to configure the electrical connector, achieve cost reduction for manufacturing, etc., and simplify the connecting work of connecting the electrical connector to a twisted pair cable.

According to a ninth aspect of the present invention, the electrical connector in one of the first through the eighth aspects may be characterized by attaching a plurality of pairs of single wires that are respectively untwisted to the connector main body, respectively disposing untwisted portions of single wires of the plurality of pairs on the basal end side of the base portion, providing a plurality of cable holding portions, and respectively holding the untwisted portions of the single wires of the plurality of pairs disposed on the basal end side of the base portion by the cable holding portions.

With the configuration, it is possible to efficiently reduce the impedance at the respective untwisted portions of the plurality of twisted pair cables. In addition, it is possible to efficiently control reduction of the noise performances at the end portions of the plurality of twisted pair cables.

According to a tenth aspect of the present invention, in the electrical connector in one of the first through the third aspects, the base portion has a bottom plate portion that forms a bottom plate of the base portion and a pair of side plate portions that form lateral walls of the base portion, the cable holding portion has a pair of separation wall portions, the pair of separation wall portions is disposed between the pair of side plate portions on the bottom plate portion of the base portion, rises up in relative to the bottom plate portion of the base portion, extends being parallel to each other until reaching or getting close to the connector main body from the basal end section of the base portion, and the untwisted portion is held between the pair of separation wall portions of the cable holding portion. The cover portion is formed to be flat, and is provided on the base portion so as to cover the whole space between the pair of dividing walls of the cable holding portion from thereabove.

According to the tenth aspect of the present invention, in the electrical connector, the whole circumference of the untwisted portion is fully covered with the separation wall portions of the cable holding portion, the bottom plate portion of the base portion, and the cover portion, any of which is made of a conductive material. Therefore, it is possible to securely reduce the impedance at the untwisted portion and more effectively achieve impedance matching between circuits or devices that are connected via the electrical connector and the twisted pair cable. In addition, it is possible to securely control reduction of the noise performances originally owned by the twisted pair cable at the end of the twisted pair cable connected to the electrical connector.

According to an eleventh aspect of the present invention, the electrical connector in the first aspect may be characterized by that the cable holding portion has a substrate section to be mounted on the bottom plate portion of the base portion and the pair of separation wall portions is provided on the bottom plate portion.

According to the eleventh aspect of the present invention, in the electrical connector, it is possible to form the cable holding portion as a single member having a substrate section and a pair of separation wall portions by providing the pair of separation wall portions of the cable holding portion on the substrate section. With the configuration, it is possible to improve the assembling efficiency of the electrical connector.

According to a twelfth aspect of the present invention, the electrical connector in the first aspect may be characterized by that the cable holding portion has a latching section that positions the substrate section and the pair of separation wall portions on the bottom plate portion of the base portion and latches to the base portion.

According to the twelfth aspect of the present invention, in the electrical connector, it is possible to easily and highly precisely position and attach the cable holding portion to the base portion and make assembling of the electrical connector easier and more efficient.

According to a thirteenth aspect of the present invention, the electrical connector in one of the tenth through the twelfth aspects may be characterized by that the cover portion has an inner lid section, which is made of a conductive material, goes inside the pair of separation wall portions of the cable holding portion, and fully covers the untwisted portion held between the pair of separation wall portions inside the pair of separation wall portions from thereabove.

According to the thirteenth aspect of the present invention, in the electrical connector, the whole circumference of the untwisted portion is covered by the separation wall portions of the cable holding portion, the bottom plate portion of the base portion (the substrate section of the cable holding portion if the cable holding portion has a substrate section), and the inner lid section of the cover portion, any of which is made of a conductive material, and the outer circumference side is fully covered by the side plate portions of the base portion, the bottom plate portion of the base portion, and the cover portion, any of which is made of a conductive material. Since the untwisted portion is totally surrounded doubly by conductive materials as described above, it is possible to significantly enhance the shielding of the untwisted portion, and it is possible to even more securely control reduction of the impedance and noise performance at the untwisted portion.

According to a fourteenth aspect of the present invention, the electrical connector in one of the tenth through the thirteenth aspects may be characterized by that a plurality of pairs of single wires, which are respectively untwisted, are attached to the connector main body, the cable holding portion has a plurality of pairs of the separation wall portions, and the untwisted portions of single wires of the plurality of pairs of single wires are respectively held between the plurality of pairs of separation wall portions.

With the configuration, it is possible to efficiently and more securely reduce the impedance at the respective untwisted portions of the plurality of twisted pair cables.

According to a fifteenth aspect of the present invention, the electrical connector in one of the first through the fourteenth aspects may be characterized by that the twisted pair cable is a shielded twisted pair cable that has a conductive shield made of a conductive material that covers together at least the pair of single wires twisted to each other and an insulating shield made of an insulating material to cover the conductive shield. The twisted pair cable has a conductive shied connecting section, which is provided on the basal end side of the base portion, and connects the conductive shield to the base portion while an end portion of each single wire at the end section of the shielded twisted pair cable is attached to the connector main body and the untwisted portion is held by the cable holding portion.

In this way, it is possible to ground the base portion and the cable holding portion by electrically connecting the grounded conductive shield to the base portion via the conductive shield connecting section, and it is possible to easily obtain an effect of reducing the impedance of the untwisted portion.

According to a sixteenth aspect of the present invention, a method is for connecting an end portion of a twisted cable, which is made by twisting to each other a pair of single wires having a conductor and an insulator that coat the conductor, to an electrical connector. The method includes a step of untwisting the pair of single wires at an end portion of the twisted pair cable and attaching the end portion of each single wire to a connector main body made of an insulating material; a step of disposing the untwisted pair of single wires of the twisted pair cable so as to be parallel to each other or get close or contact to each other at a basal end side of a base portion, at a front end side of which the connector main body is disposed; a step of holding the pair of single wires, which is disposed at the basal end side of the base portion, with the cable holding portion made of a conductive material at the basal end side of the base portion; and a step of attaching a cover portion to the base portion so as to position at least the untwisted section and the cable holding portion between the cover portion and the base portion.

With the configuration, it is possible to reduce the impedance at the untwisted portion of the twisted pair cable, and it is possible to control the reduction of the noise performances at an end portion of the twisted pair cable.

According to the invention, it is possible to control increase of the impedance or reduction of the noise performance at the untwisted portion of the twisted pair cable, especially the shielded twisted pair cable. In addition, it is possible to easily or securely connect the twisted pair cable to the electrical connector, and to shorten time required for the connecting work or to improve the yield.

DETAILED DESCRIPTION OF PREFERRED EMBODIMENTS

Hereunder, embodiments of the invention will be described with reference to the accompanying drawings.

(First Embodiment)

Figure 1:
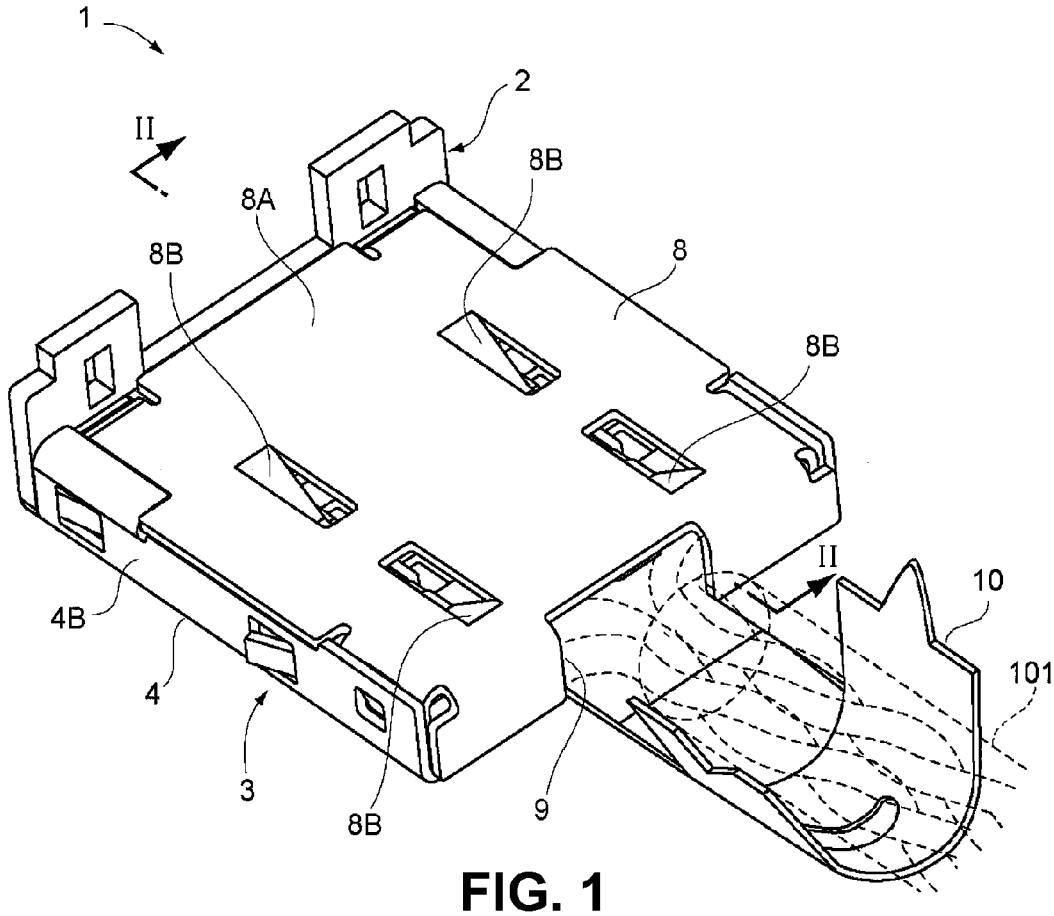
FIG. 1 is a perspective view of an electrical connector according to a first embodiment of the invention.
Figure 2:
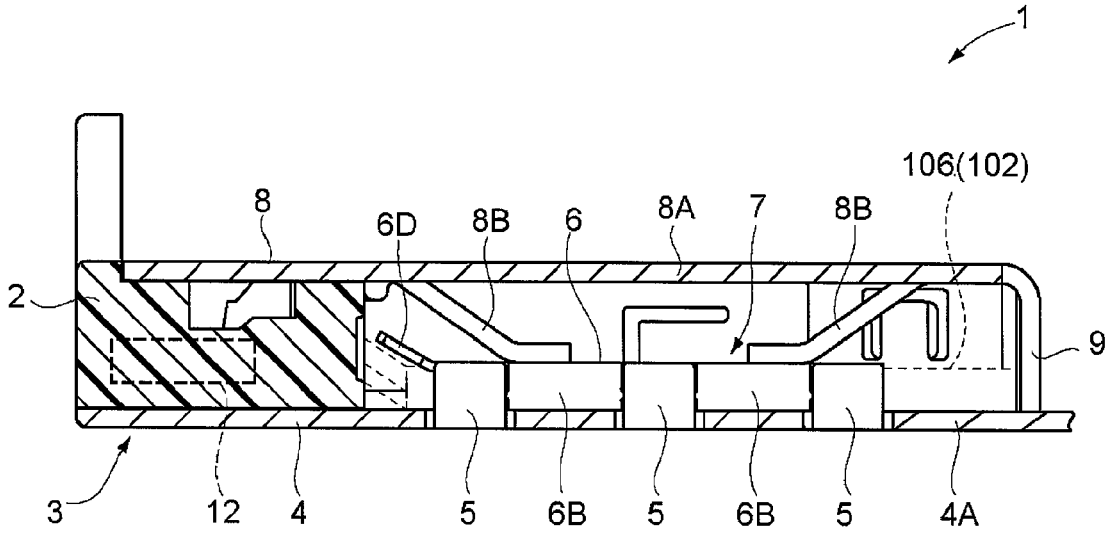
FIG. 2 is a sectional view of the electrical connector of the first embodiment of the invention, which is viewed from a II-II direction indicated with an arrow in FIG. 1.
Figure 8:
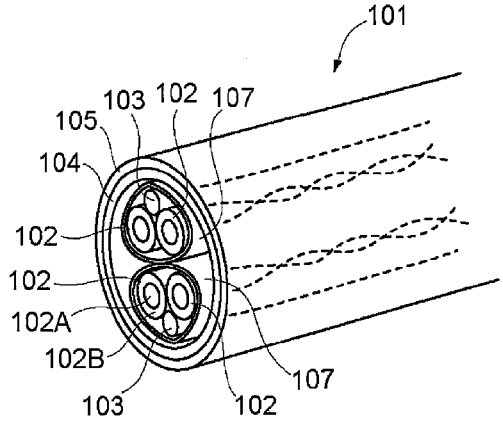
FIG. 8 is a perspective view of an end portion of the shielded twisted pair cable.

First, an electrical connector according to a first embodiment of the invention will be described. FIGS. 1 and 2 show an electrical connector according to the first embodiment of the invention. On the other hand, FIGS. 8 and 9 show a shielded twisted pair cable to be connected to the electrical connector of FIG. 1.

The electrical connector 1 according to a first embodiment of the invention is an electrical connector to connect to an end portion of a shielded twisted pair cable 101. As shown in FIG. 8, the shielded twisted pair cable 101, which is described as an example in the embodiment, has two twisted wire pairs made by twisting a pair of single wires 102 together. Furthermore, the shielded twisted pair cable 101 has a drain wire 103 for each twisted wire pair, and each twisted wire pair is covered together with the drain wire 103 by a conductive coating film 107.

In addition, the two twisted wire pairs respectively covered together with the drain wire 103 by the conductive coating film 107 is covered together by a conductive shield 104, and further, the conductive shield 104 is covered by an insulating shield 105. Each single wire 102 has a linear conductor 102A that is made of, for example, copper and an insulator 102B made of polyvinyl chloride or the like to coat the conductor 102A. Moreover, the conductive shield 104 is made of a conductive material such as copper alloy or aluminum, and the insulating shield 105 is made of an insulating material such as polyester or polypropylene.

Figure 9:
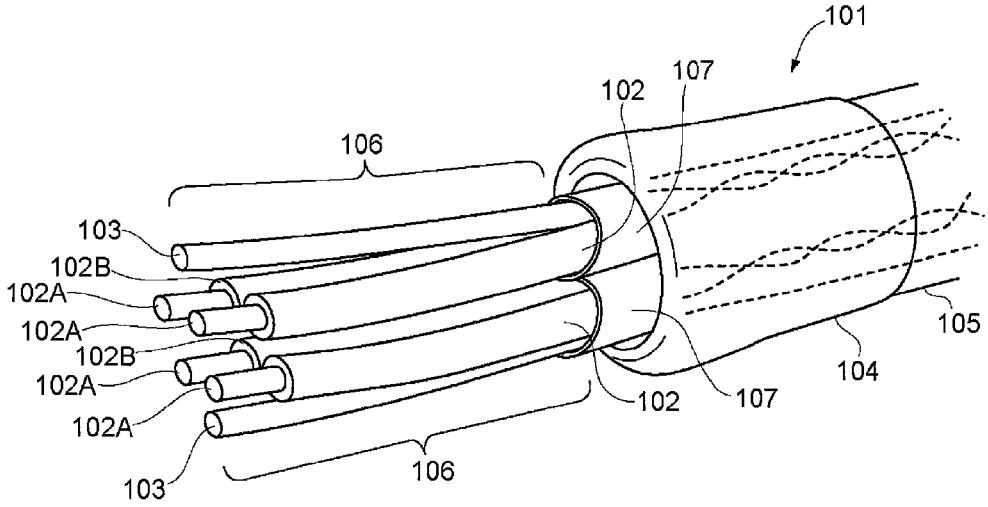
FIG. 9 is a perspective view, in which an insulating shield is removed at an end portion of the shielded twisted pair cable, the conductive shield is folded back, each conductive coating film is removed, two pairs of single wires are untwisted, and end portion of conductor of each single wire is exposed.

Upon connecting the electrical connector 1 to the shielded twisted pair cable 101, as shown in FIG. 9, the insulating shield 105 is removed at an end portion of the shielded twisted pair cable 101 on the side of connecting to the electrical connector 1, the conductive shield 104 is folded back to the outer side, and each conductive coating film 107 is removed. Then, the two pairs of single wires 102 are respectively untwisted, and then the insulator 102B is removed at an end portion of each single wire 102, so as to expose the end portion of the conductor 102A.

Hereafter, the untwisted portion of the single wires 102 of each pair at end portions of the shielded twisted pair cable 101 is referred to as "untwisted portion 106". Each untwisted portion 106 refers a portion that extends from a part where each single wire 102 starts to expose by folding back the conductive shield 104 and removing each conductive coating film 107 to the end section of each untwisted single wire 102.

In FIG. 1, the electrical connector 1 is generally composed of a connector main body 2, a shell member 3, and a cable fastening securing section 10.

The connector main body 2 is made of an insulating material, and has a plurality of attaching ports 2A (see FIG. 3) formed to attach an end portion of each single wire 102 of the untwisted two wire pairs of the shielded twisted pair cable 101. In addition, inside the connector main body 2, there is provided a terminal housing section (not illustrated) to house connecting terminal 12 (see FIG. 2) to electrically connect to an end portion of the conductor 102A of each single wire 102.

The shell member 3 is to hold the connector main body 2 and an end portion of the shielded twisted pair cable 101. More specifically, as shown in FIG. 1, the shell member 3 has a base portion 4 and a shell cover portion 8, and holds the connector main body 2 and an end portion of the shielded twisted pair cable 101, whose end section of each single wire 102 is attached to the connector main body 2 as shown in FIG. 2. Furthermore, as shown in FIG. 2, the shell member 3 has a cable holding portion 7 between the base portion 4 and the shell cover portion 8 to hold each untwisted portion 106 of the shielded twisted pair cable 101.

Figure 3:
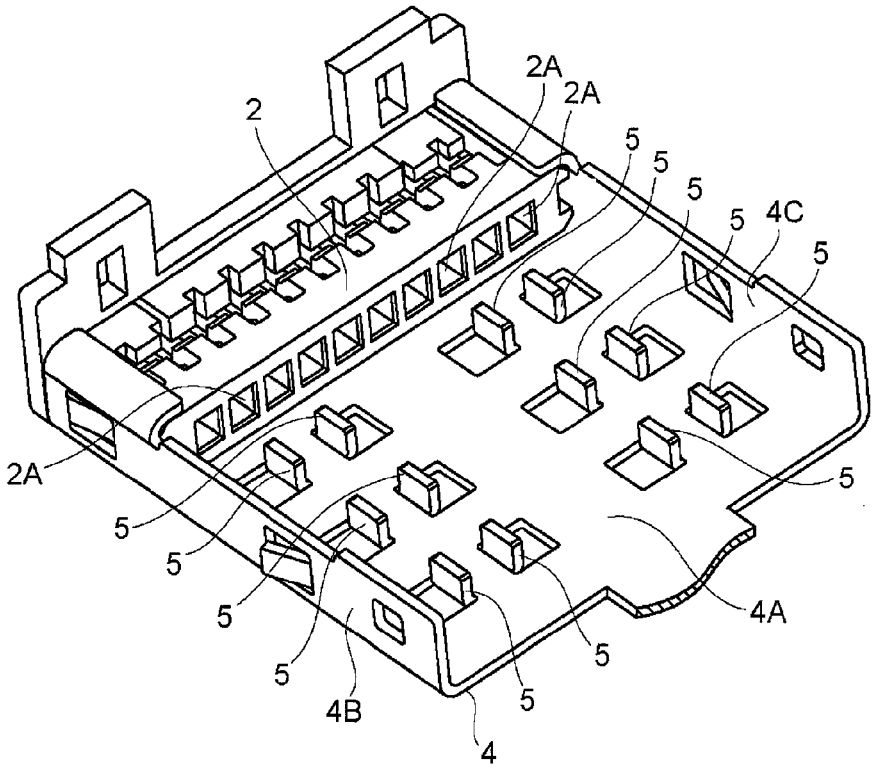
FIG. 3 is a perspective view of the electrical connector of the first embodiment of the invention, in which a connector main body is disposed on a base portion.
Figure 4:
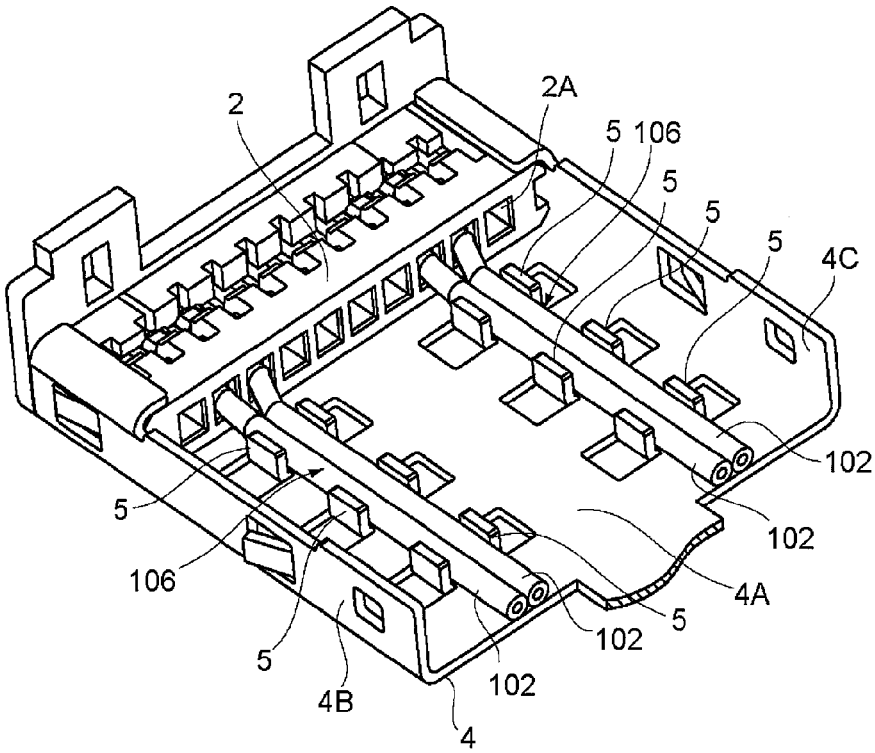
FIG. 4 is a perspective view of the electrical connector of the first embodiment of the invention, in which a connector main body and an untwisted portion of the shielded twisted pair cable are disposed on the base portion.
Figure 5:
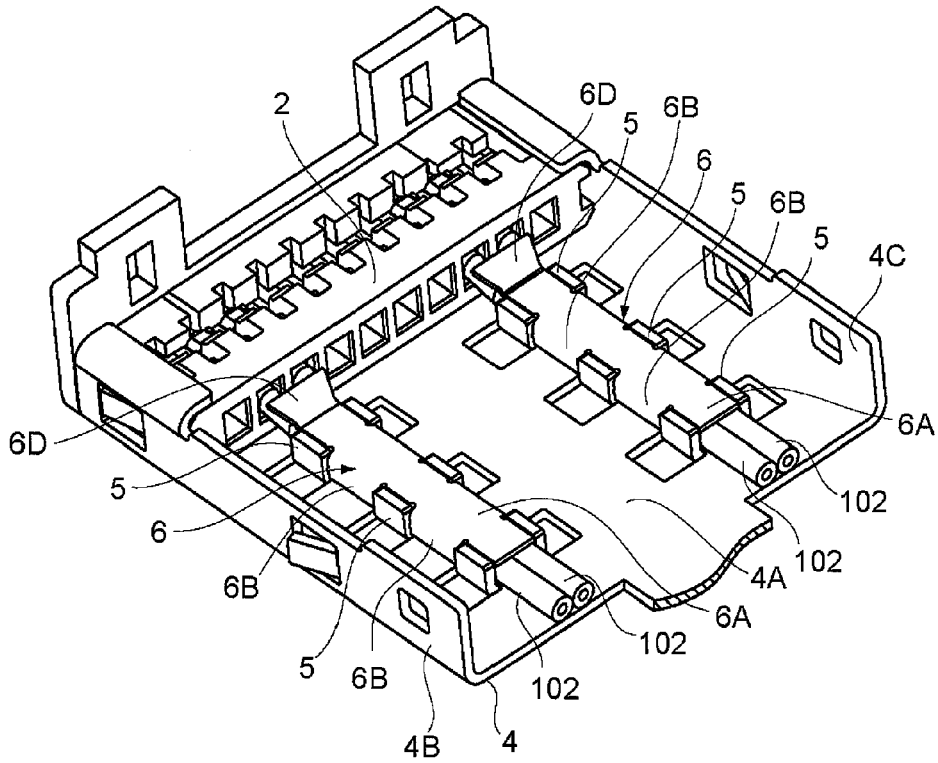
FIG. 5 is a perspective view of the electrical connector of the first embodiment of the invention, in which a cable cover member is attached to the base portion.

FIG. 3 shows a state where the connector main body 2 is disposed on the base portion 4 of the shell member 3, and FIG. 4 shows a state where each untwisted portion 106 of the shielded twisted pair cable 101 is further disposed on the base portion 4. FIG. 5 shows a state where each cable cover member 6 is further attached to the base portion 4.

In FIG. 3, the base portion 4 of the shell member 3 is made of a conductive material such as copper alloy. The base portion 4 is formed by bending both end portions of a quadrate sheet metal to form a square-bottomed shaped lateral section which is opened upward, and has a bottom plate portion 4A and side plate portions 4B and 4C arranged on both sides of the bottom plate portion 4A in the width direction. The connector main body 2 is disposed between the side plate portions 4B and 4C on the bottom plate portion A positioned at a front end side of the base portion 4.

On the other hand, as shown in FIG. 4, each untwisted portion 106 of the shielded twisted pair cable 101, in which an end portion of each single wire 102 is attached to the connector main body 2. More specifically, on the bottom plate portion 4A provided on the basal end side of the base portion 4, two untwisted portions 106, which respectively correspond to two wire pairs of the shielded twisted pair cable 101, are disposed being away from each other in the width direction of the base portion 4.

Furthermore, the pair of single wires 102 of each untwisted portion 106 is held by a plurality of lanced (cut and bent up) sections 5 while the pair of single wires 102 is being positioned to be parallel to each other and get close or contact to each other. In other words, in two areas that are away from each other in the width direction on the bottom plate portion 4A of the base portion 4, i.e. two areas to dispose the two untwisted sections 106 that respectively correspond to the two wire pairs, lanced sections 5, for example six lanced sections, are respectively formed.

More specifically, on the base plate section 4A of the base portion 4, in the area to dispose the untwisted portion 106 that corresponds to the wire pair attached on the left side in FIG. 4, three lanced sections 5 are arranged in two rows at specified intervals from the basal end side to the front end side of the bottom plate portion 4A. The two rows are respectively linear and parallel to each other. The distance between the two rows (i.e. the distance between the two lanced sections that face each other in the width direction of the base portion 4) is for example, generally about two times the diameter of each single wire 102. Each lanced section 5 protrudes upward from the bottom plate portion 4A and the height dimension is for example, almost equal to the diameter of each single wire 102.

By attaching a pair of single wires 102 of the untwisted portion 106 between the two rows of the lanced sections 5, the pair of single wires 102 of the untwisted portion 106 is positioned by the lanced section 5 and held thereby. More specifically, by clamping both sides of a pair of single wires 102 of the untwisted portion 106 by the three lanced sections 5 that are linearly disposed in each row, the pair of single wires 102 is positioned to be parallel to each other.

In addition, since the distance between the lanced sections 5 that face each other is almost twice the diameter of each single wire 102, the pair of single wires 102 of the untwisted portion 106 is positioned while being close or contacting to each other. This is the same also in an area on the base plate section 4A of the base portion 4, where the untwisted portion 106 that correspond to the wire pair attached on the right side is disposed.

Furthermore, as shown in FIG. 5, onto the base portion 4, for example, two cable cover members 6 are attached, and each untwisted portion 106 disposed on the bottom plate portion 4A of the base portion 4 is covered by the cable cover member 6. Here, FIG. 6 is an enlarged view of the cable cover member 6 and FIG. 7 shows a state where the cable cover member 6 is attached to the base portion 4.

Figure 6:
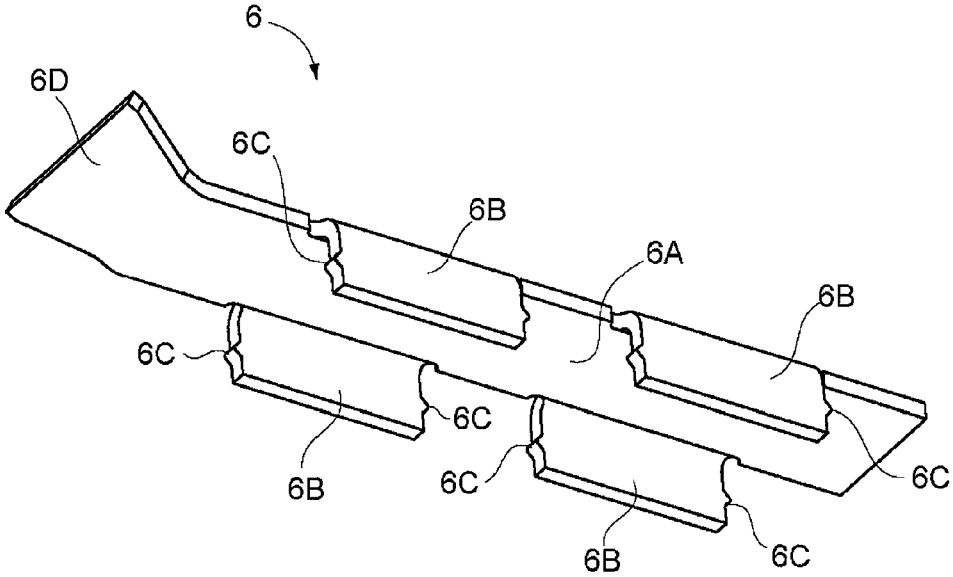
FIG. 6 is a perspective view of the cable cover member of the electrical connector of the first embodiment of the invention.

As shown in FIG. 6, the cable cover member 6 is a member independent from the base portion 4, and is made of, for example, the same conductive material as that of the base portion 4. In addition, the cable cover member 6 has a ceiling plate section 6A that is formed to be a long flat section, and a bent section, for example, four bent sections 6B formed by bending both sides of the ceiling plate section 6A in the width direction, protrusions 6C formed on each bent section 6B, and a projecting section 6D that projects from a front end side of the ceiling plate section 6A to the front end side of the base portion 4 upon attaching onto the base portion 4.

Figure 7:
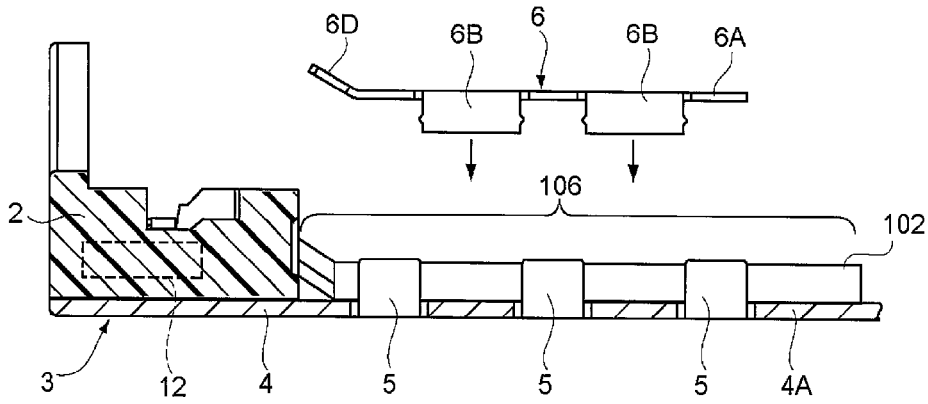
FIG. 7 is a sectional view of the electrical connector of the first embodiment of the invention upon attaching the cable cover member to the base portion, which is viewed from the same direction as FIG. 2.

As shown in FIG. 7, the cable cover member 6 is attached to the base portion 4 so as to cover the untwisted portion 106, which is disposed on the bottom plate portion 4A of the base portion 4, from thereabove. With the configuration, the ceiling plate section 6A of the cable cover member 6 links between the lanced sections 5 provided on both sides of the untwisted portion 106, and covers an upper side of the untwisted portion 106.

At the same time, each bent section 6B of the cable cover member 6 engages in between the lanced sections 5, and covers a right side and a left side of the untwisted portion 106 with the lanced sections 5. Accordingly, whole circumference of the pair of single wires 102 of the untwisted portion 106 is covered by a portions of the ceiling plate section 6A of the cable cover member 6, the bent section 6B, the lanced sections 5, and the bottom plate portion 4A of the base portion 4, where the untwisted portion 106 is disposed.

Moreover, the ceiling plate section 6A of the cable cover member 6 extends from a basal end section of the base portion 4 to a position right before reaching the connector main body 2, and the bent sections 6B and the lanced sections 5, which are alternately provided, generally extend from the basal end section of the base portion 4 to a position reaching the connector main body 2.

Moreover, the projecting section 6D of the cable cover member 6 extends to a position reaching the connector main body 2. With the configuration, the untwisted portion 106 is continuously covered from the basal end section of the base portion 4 to the connector main body 2. As a result, whole circumference and whole range in the length direction of each untwisted section 16 is covered by a conductive material.

In addition, the protrusions 6C of the cable cover member 6 are caught by the lanced section 5 upon attaching the base portion 4 to the cable cover member 6, and thereby the cable cover member 6 is secured on the base portion 4.

Here, a portion to cover each untwisted portion 106, where the untwisted section 106 is disposed on the cable cover member 6, the lanced sections 5, and the bottom plate portion 4A of the base portion 4, composes the cable holding portion 7 (see FIG. 2). In addition, the cable cover member 6 is a specific example of the conductive member and the lanced section 5 is a specific example of the protrusion.

Referring again to FIG. 1, the shell cover portion 8 is provided on the base portion 4, so as to position the connector main body 2, an end section of the shielded twisted pair cable 101 including each untwisted section 106, and the cable holding portion 7 between the shell cover portion 8 and the base portion 4, and houses the connector main body 2, an end portion of the shielded twisted pair cable 101 including each untwisted section 106, the cable cover member 6, etc. The shell cover portion 8 is attached to a base portion 4, with a latching structure, which is not illustrated in the figure but for example, is formed between the shell cover portion 8 and side plate portions 4B and 4C of the base portion 4.

The shell cover portion 8 is, for example, made of the same conductive material as that of the base portion 4, and has a cover plate section 8A that cover an upper side of the base portion 4. Furthermore, the cover plate section 8A has pressing sections 8B, which protrude towards the base portion 4, at positions that correspond to those of each cable cover member 6. Upon attaching the shell cover portion 8 to the base portion 4, each pressing section 8B contacts with an upper face of the ceiling plate section 6A of the cable cover member 6, and presses the cable cover member 6 towards the base portion 4. Here, the shell cover portion 8 may be also made of an insulating material.

In addition, as shown in FIG. 1, on the basal end side of the electrical connector 1, there is provided an insertion through hole 9 to insert an end portion of a so-called "end-treated" shielded twisted pair cable 101 as shown in FIG. 9 between the base portion 4 and the shell cover portion 8. Furthermore, on the basal end side of the electrical connector 1, there is provided a cable fastening securing section 10 to fasten and secure the end-treated shielded twisted pair cable 101 at a portion where the conductive shield 104 is folded back and its periphery. The cable fastening securing section 10 is made of the same conductive material as that of the base portion 4, and is made so as to be continuously integrated to the base portion.

The cable fastening securing section 10 fastens a portion of the shielded twisted pair cable 101, where the conductive shield 104 is folded back, so as to contact to the conduct shield 104 and electrically connect thereto. With the configuration, when the conductive shield 104 of the shielded twisted pair cable 101 is grounded, the base portion 4 is grounded via the cable fastening securing section 10. Furthermore, the lanced sections 5 of the base portion 4 and the cable cover member 6 that contacts with the lanced sections 5 are also grounded. As a result, each untwisted section 106 is covered by a grounded conductive material. Here, the cable fastening securing section 10 is a specific example of a conductive shield connecting section.

A method of connecting the electrical connector 1 configured as above to an end portion of the shielded twisted pair cable 101 is as follows.

First, as shown in FIG. 9, the insulating shield 105 is removed at an end portion of the shielded twisted pair cable 101, the conductive shield 104 is folded back outside, and each conductive coating film 107 is removed. Then, two pairs of single wires 102 are respectively untwisted, the insulator 102B is removed at an end portion of each single wire 102 so as to expose the end portion of the conductor 102A. Then, a connecting terminal 12 is crimped to an end portion of the conductor 102A of the each exposed single wire 102, and an end portion of the conductor 102A of each single wire 102, to which the connecting terminal 12 is crimped, is attached to an attaching port 2A of the connector main body 2.

Thereafter, a pair of single wires 102 of each untwisted portion 106 is disposed between two rows of the lanced sections 5 on the bottom plate portion 4A on the basal end side of the base portion 4, so as to dispose the pair of single wires 102 to be parallel or contact or get close to each other.

Then, the cable cover member 6 is attached to the base portion 4 so as to cover each untwisted section 106, which is disposed on the bottom plate portion 4A on the basal end side of the base portion 4, from thereabove.

Then, the shell cover portion 8 is attached to the base portion 4, the connector main body 2, an end section of the shielded twisted pair cable 101 including each untwisted section 106 and each cable cover member 6 are housed between the base portion 4 and the shell cover portion 8, and each cable cover member 6 is pressed by the pressing member 8B of the shell cover portion 8.

Next, the shielded twisted pair cable 101 is fastened and secured onto the cable fastening securing section 10. At this time, contacting the conductive shield 104, which is folded back, to the cable fastening securing section 10, the conductive shield 104 and the cable fastening securing section 10 are electrically connected. With the procedure, connection of the electrical connector 1 to an end portion of the shielded twisted pair cable 101 is completed.

As described above, according to the electrical connector 1 of the first embodiment of the invention, upon connecting the electrical connector 1 to the shielded twisted pair cable 101, it is possible to position the pair of single wires 102 of each untwisted portion 106 of the shielded twisted pair cable 101 while being parallel to each other and getting close to or contacting to each other. Furthermore, it is possible to cover the whole circumference and whole range in the length direction of each untwisted portion 106 by a conductive material.

With the configuration, it is possible to control the increase of the impedance at the untwisted portion 106, even if each single wire 102 is untwisted at an end portion of the shielded twisted pair cable 101 to connect the electrical connector 1 to the shielded twisted pair cable 101. Therefore it is possible to achieve impedance matching between circuits or devices that are connected via the electrical connector 1 and the shielded twisted pair cable 101. Accordingly, it is possible to control signal reflection and noise generation due to mismatched impedance. In addition, covering each untwisted portion 106 by a conductive material within the electrical connector 1, it is possible to control reduction of noise performances originally owned by the shielded twisted pair cable 101.

Furthermore, according to the electrical connector 1 of the first embodiment of the invention, by disposing the untwisted portion 106 on the bottom plate portion 4A of the base portion 4 and putting the cable cover member 6 thereover, it is possible to control increase of impedance and reduction of noise performances. Therefore, it is possible to achieve the above effects with more simple work in comparison with a case of bundling an untwisted portion of the twisted pair cable with a tape or tube as described in Patent Reference 1. Therefore, according to the first embodiment of the first invention, it is possible to shorten the time required for connecting the electrical connector 1 to the shielded twisted pair cable 101, to reduce generation of poor connection between the shielded twisted pair cable 101 and the electrical connector 1 and improve the yield.

(Second Embodiment)

Figure 10:
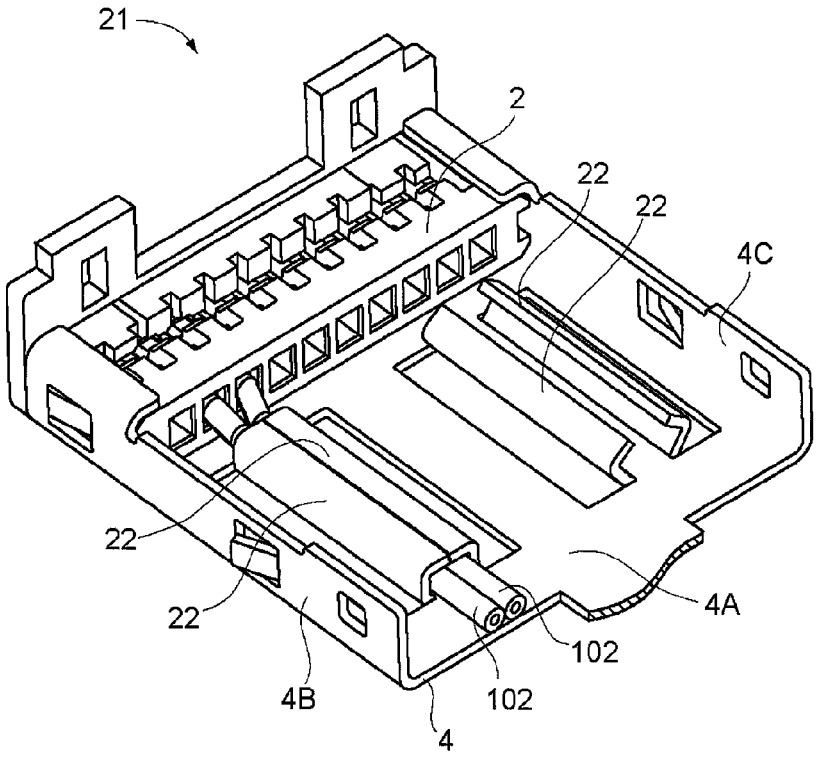
FIG. 10 is a perspective view of an electrical connector according to a second embodiment of the invention, which is in the middle of connecting the shielded twisted pair cable.

Next, an electrical connector according to a second embodiment of the invention will be described. FIG. 10 shows an electrical connector according to the second embodiment of the invention, which is in the middle of connecting the shielded twisted pair cable. Here, in FIG. 10, the same reference numerals are used to the same elements as those of the electrical connector 1 of the first embodiment and the explanation will be omitted.

In FIG. 10, the electrical connector 21 according to the second embodiment of the invention has lanced sections provided on the bottom plate portion 4A of the base portion 4 so as to continuously extend from a basal end section of the base portion 4 to a position right before the connector main body 2. In addition, each lanced section 22 is formed to have a V-shaped lateral section.

Prior to disposing the untwisted portion 106, upper ends of the lanced sections 22 are away from each other as in a pair of lanced sections 22 that face each other on the right side of FIG. 10, and thereby it is possible to attach the untwisted portion 106 between the lanced sections 22. Then, after the untwisted portion 106 is attached and the pair of single wires 102 of the untwisted portion 106 is disposed so as to be parallel and get close to or contact to each other, the lanced sections 22 are pushed to bend so as to have their upper ends of the lanced sections 22 contact to each other as the pair of lanced sections that face each other on the left side of FIG. 10.

As a result, the whole circumference and the whole range in the length direction of the untwisted portion 106 is covered by a portion where the untwisted part 106 is disposed in each lanced section 22 and a bottom plate portion 4A of the base portion 4. Since each lanced section 22 is formed from the same conductive material as that of the base portion 4, the whole circumference and the whole range in the length direction of each untwisted section 106 is covered by the conductive material.

According to the electrical connector 21 of the second embodiment of the invention having the above-described configuration, it is possible to obtain almost similar effects to those obtained by the aforementioned electrical connector 1 of the first embodiment of the invention. Especially since the electrical connector 21 of the second embodiment of the invention is configured to cover an upper side, right side, and left side of each untwisted portion 16 with each lanced section 22, it is not necessary to provide a cable cover member as in the first embodiment, and furthermore, it is also not necessary to provide a pressing section on the shell cover portion 8 to press the cable cover member.

As a result, it is possible to reduce the number of members that compose the electrical connector 21, to simplify a shape of the shell cover portion 8, and to reduce the manufacturing cost. In addition, attaching the untwisted portion 106 between the lanced sections 22 that face to each other and the lanced sections 22 are bent to close, it is possible to cover the untwisted portion 106, so that it is possible to further simplify the connecting work between the shielded twisted pair cable 101 and the electrical connector 21.

(Third Embodiment)

Figure 11:
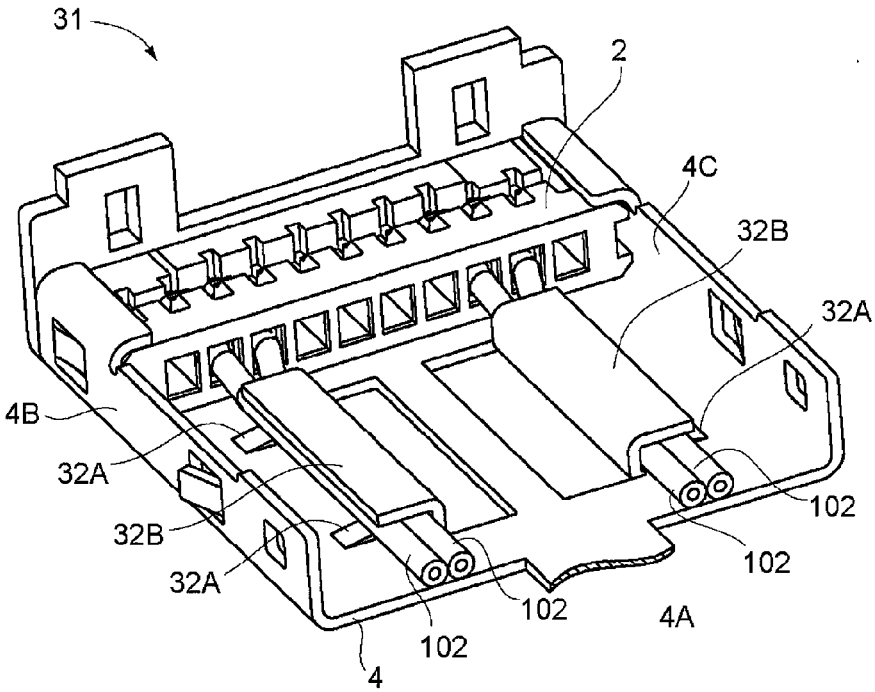
FIG. 11 is a perspective view of an electrical connector according to a third embodiment of the invention, which is in the middle of connecting the shielded twisted pair cable.

Next, an electrical connector according to the third embodiment of the invention will be described. FIG. 11 shows the electrical connector according to the third embodiment of the invention, which is in the middle of connecting to a shielded twisted pair cable. Here, in FIG.

11, the same reference numerals are used for the same elements as those in the electrical connector 1 according to the first embodiment and the explanation will be omitted.

While each lanced section 22 of the electrical connector 21 according to the second embodiment of the invention is configured to clamp the both sides of the untwisted portion 106 in the width direction, each lanced section 32B of the electrical connector 31 according to the third embodiment of the invention shown in FIG. 11 is configured to surround the untwisted portion 106 from one side to the other in the width direction.

More specifically, in the electrical connector 31, the lanced sections that cover each untwisted portion 106 is composed of lanced sections 32A, e.g. two lanced sections, that relatively slightly protrude from the bottom plate portion 4A of the base portion 4, and one lanced section 32B that relatively largely protrudes from the bottom plate portion 4A of the base portion 4, has a V-shaped lateral cross-section, and surround the untwisted portion 106. A pair of single wires 102 of the untwisted portion 106 is disposed to be parallel to each other and get close or contact to each other between each lanced section 32A and the lanced section 32B. Most part of the periphery or almost whole range in the length direction of the untwisted portion 106 is covered by the lanced section 32B.

Also with the electrical connector 31 according to the third embodiment of the invention that is configured as above, it is possible to obtain almost similar effects to those from the electrical connector 1 or 21 according to the first or the second embodiment of the invention. Especially, according to the electrical connector 31 of the third embodiment of the invention, similarly to the electrical connector 32 of the second embodiment of the invention, since it is not necessary to provide a cable cover member in case of the first embodiment and a pressing section to press the cable cover member, it is possible to reduce manufacturing cost, etc.

(Fourth Embodiment)

Figure 12:
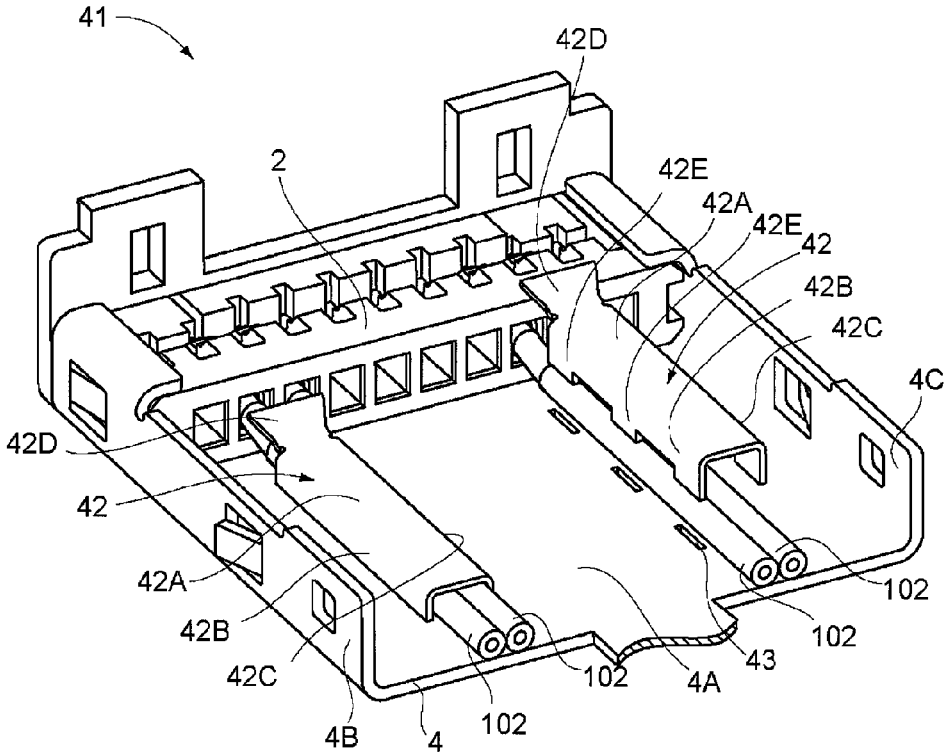
FIG. 12 is a perspective view of an electrical connector according to a fourth embodiment of the invention, which is in the middle of connecting the shielded twisted pair cable.

Next, an electrical connector according to a fourth embodiment of the invention will be described. FIG. 12 shows the electrical connector according to the fourth embodiment of the invention, which is in the middle of connecting a shielded twisted pair cable. Here, in FIG. 12, the same reference numerals are used for the same element as those in the first embodiment, and the explanation will be omitted.

The electrical connector 41 according to the fourth embodiment of the invention, which is shown in FIG. 12, is made of a conductive material and includes a cable cover member 42 having a lateral cross-section of a squared bottomed U-shape, which includes a ceiling plate section 42A and side plate portions 42B and 42C that are provided on two sides of the ceiling plate section 42 in the width direction. Any of the ceiling plate section 42A and the side plate portions 42B and 42C of the cable cover member 42 continuously extend from a basal end portion of the base portion 4 up to right before the connector main body 2. In addition, there is provided a projecting section 42D on the front end side of the ceiling plate section 42A. Furthermore, a plurality of protrusions 42E are formed at a lower end portion of the side plate portions 42B and 42C of the cable cover member 42, and holes 43 are formed on the bottom plate portion 4A of the base portion 4 to fit the protrusions 42E therein.

A pair of single wires 102 of the untwisted portion 106 is disposed so as to be parallel to each other and get close or contact to each other, a cable cover member 42 is placed thereover from thereabove, and each protrusion 42E of the cable cover member 42 is fitted in each hole 43 of the base portion 4. With the operation, the whole circumference and the almost whole range in the length direction of the untwisted portion 106 is covered by a conductive material.

Also with the electrical connector 41 according to the fourth embodiment of the invention configured as described above, it is possible to obtain almost similar effects to those from the electrical connector 1, 21, or 31 according to the first, the second, or the third embodiment of the invention. Especially, according to the electrical connector 41 of the fourth embodiment of the invention, since it is possible to more securely cover whole circumference and almost the whole range in the length direction of each untwisted portion 106 by a conductive material, it is possible to effectively reduce the impedance and effectively control reduction of the noise performances.

(Fifth Embodiment)

Figure 13:
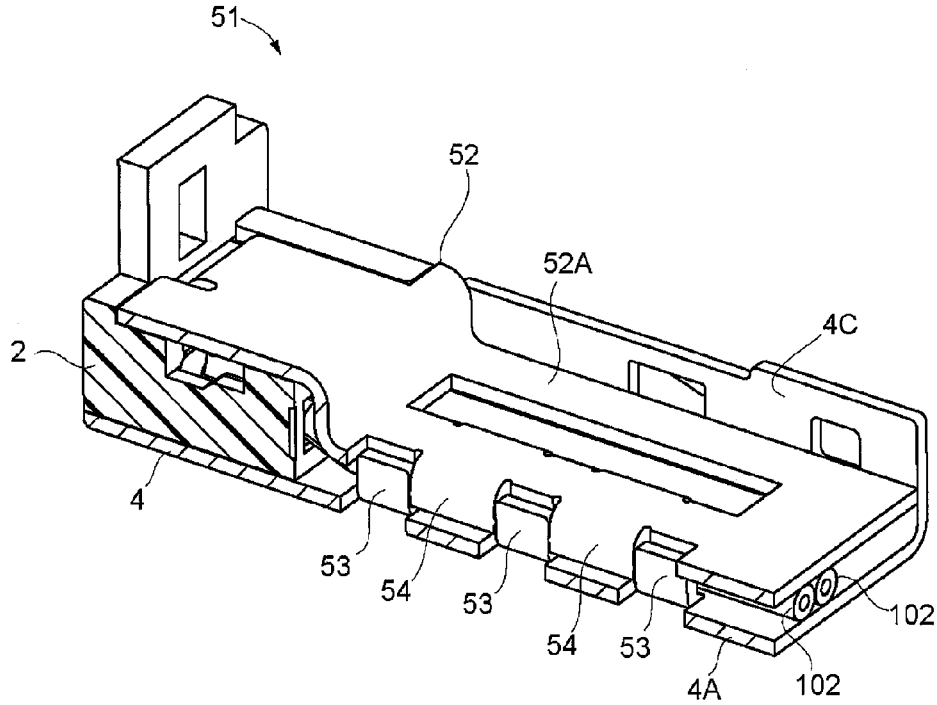
FIG. 13 is an extracted perspective view of a major part of the electrical connector according to a fifth embodiment of the invention.

Next, an electrical connector according to a fifth embodiment of the invention will be described. FIG. 13 shows an electrical connector according to the fifth embodiment of the invention, which is in the middle of connecting the shielded twisted pair cable. Here, in FIG. 13, the same reference numerals are used for the same elements as those in the electrical connector 1 according to the first embodiment, and the explanation will be omitted.

The electrical connector 51 according to the fifth embodiment of the invention shown in FIG. 13 has a structure formed to cover each untwisted portion 106 at the shell cover portion 52. More specifically, the basal end side of the cover plate section 52A of the shell cover portion 52 is bent so as to get close to the bottom plate portion 4A of the base portion 4, and the inner face on the basal end side of the cover plate section 52A gets close or contacts to an upper part of each untwisted portion 106 disposed on the base portion 4 and cover the upper part of the untwisted portion 106. Furthermore, a plurality of lanced sections 53, which are formed by cutting and bending upward a bottom plate portion 4A of the base portion 4, and a plurality of lanced sections 54, which are formed by cutting and bending downward the cover plate section 52A of the shell cover portion 52 engage to each other, so as to cover one side face of the untwisted portion 106. With the configuration, by forming the shell cover portion 52 from a similar conductive material to that of the base portion 4, it is possible to cover each untwisted portion 106 by a conductive material.

Also with the electrical connector 51 according to the fifth embodiment of the invention configured as above, it is possible to obtain almost similar effects to those of the electrical connector 1, 21, 31, or 41 according to the first, the second, the third, or the fourth embodiment. Especially, according to the electrical connector 51 of the fourth embodiment of the invention, since it is not necessary to provide a cable cover member as in the first or the fourth embodiment by forming a structure to cover each untwisted portion 106 at the shell cover portion 52, it is possible to reduce the number of members that compose the electrical connector 51 and thereby reduce the manufacturing cost, etc.

(Sixth Embodiment)

Figure 14:
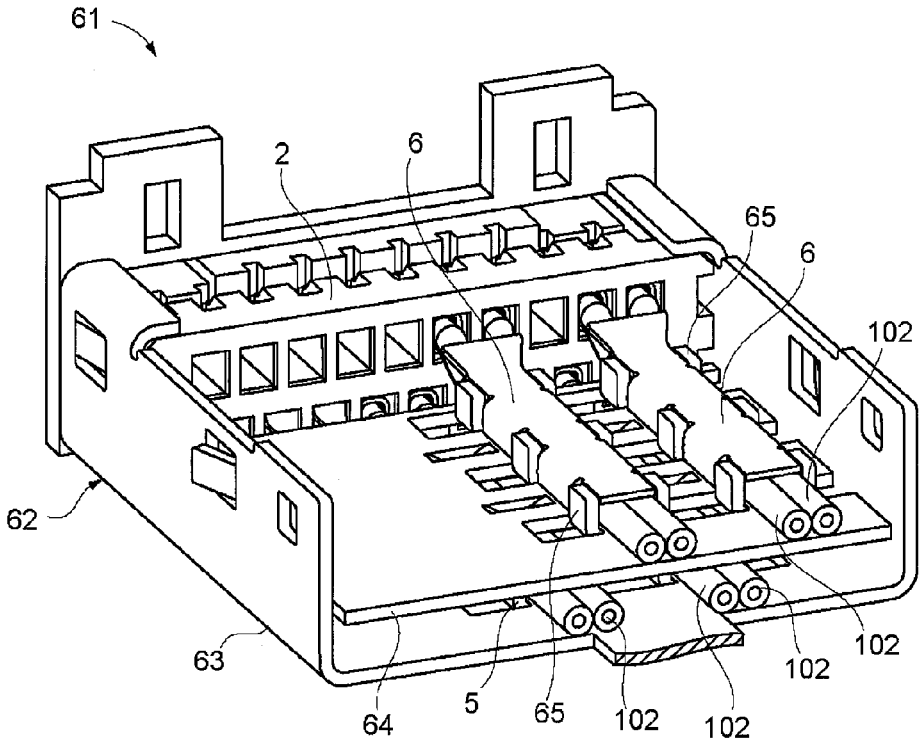
FIG. 14 is a perspective view of an electrical connector according to a sixth embodiment of the invention, which is in the middle of connecting the shielded twisted pair cable.

Next, an electrical connector according to the sixth embodiment of the invention will be described. FIG. 14 shows an electrical connector according to the sixth embodiment of the invention, which is in the middle of connecting the shielded twisted pair cable. Here, in FIG. 14, the same reference numerals are used for the same elements as those in the electrical connector 1 according to the first embodiment, and the explanation will be omitted.

The electrical connector 61 according to the sixth embodiment of the invention shown in FIG. 14 includes a intermediate plate section 64 so as to have a two-story structure in the vertical direction, so that it is possible not only to attach a plurality of paired wires in the lateral direction, but also to attach a plurality of paired wires in the vertical direction, i.e. it is possible to obtain a structure that can attach a number of paired wires. More specifically, similarly to the base portion 63, in the electrical connector 61, the intermediate plate section 64 is formed of a conductive material to have a plurality of lanced sections 65, and holds each untwisted portion 106 by clamping with the respective lanced sections 65 on the intermediate plate section 64.

Furthermore, the electrical connector 61 is configured so that cable cover portions 6 are attached to the intermediate plate section 64 for the number that corresponds to the number of paired wires disposed to the intermediate plate 64, so as to cover the whole circumference and the whole range in the length direction of each untwisted portion 106 disposed on the intermediate plate section 64.

Also with the sixth embodiment of the invention having the above-described configuration, it is possible to similar effects to those of the electrical connector 1, 21, 31, 41, or 51 according to the first, the second, the third, the fourth, or the fifth embodiment. Especially according to the electrical connector 61 of the sixth embodiment of the invention, it is possible to control increase of impedance and reduction of noise performances of many paired wires that are connected to the electrical connector 61. In addition, according to the electrical connector 61 of the sixth embodiment of the invention, it is possible to easily and securely connect many paired wires and the electrical connector 61.

(Seventh Embodiment)

Figure 15:
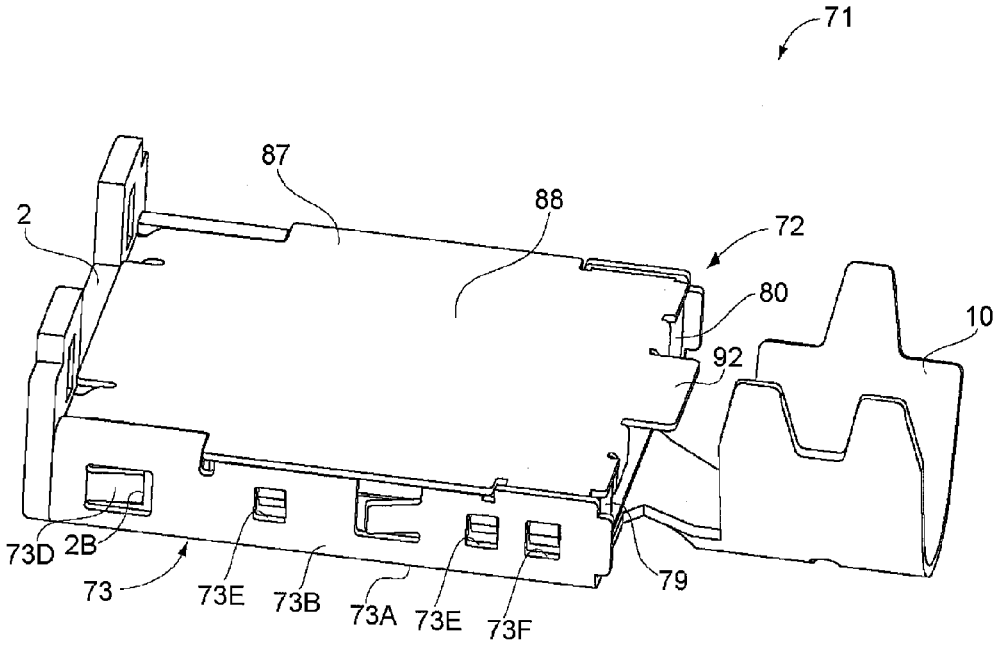
FIG. 15 is a perspective view of an electrical connector according to a seventh embodiment of the invention.
Figure 16:
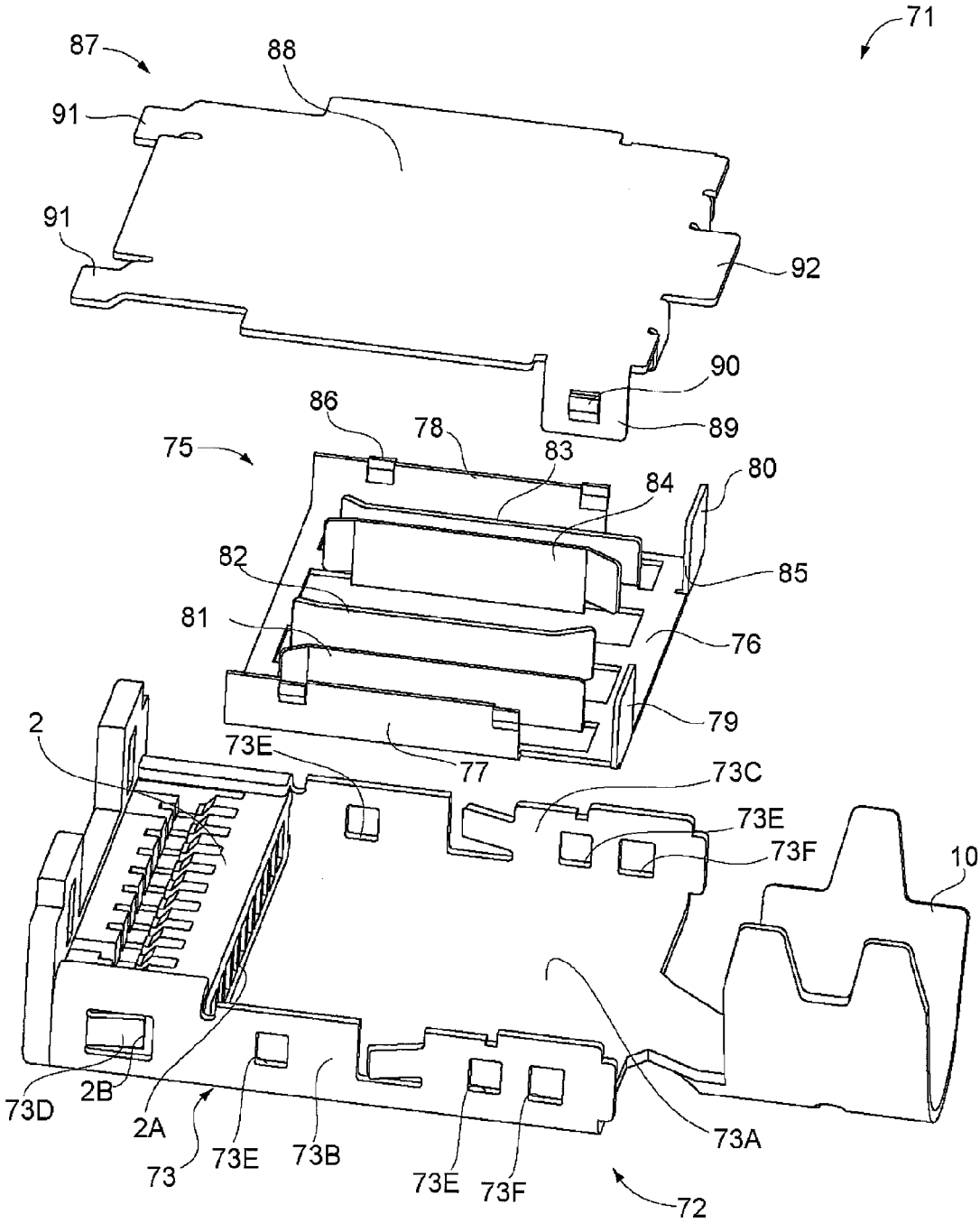
FIG. 16 is an exploded perspective view of the electrical connector according to the seventh embodiment of the embodiment.
Figure 17:
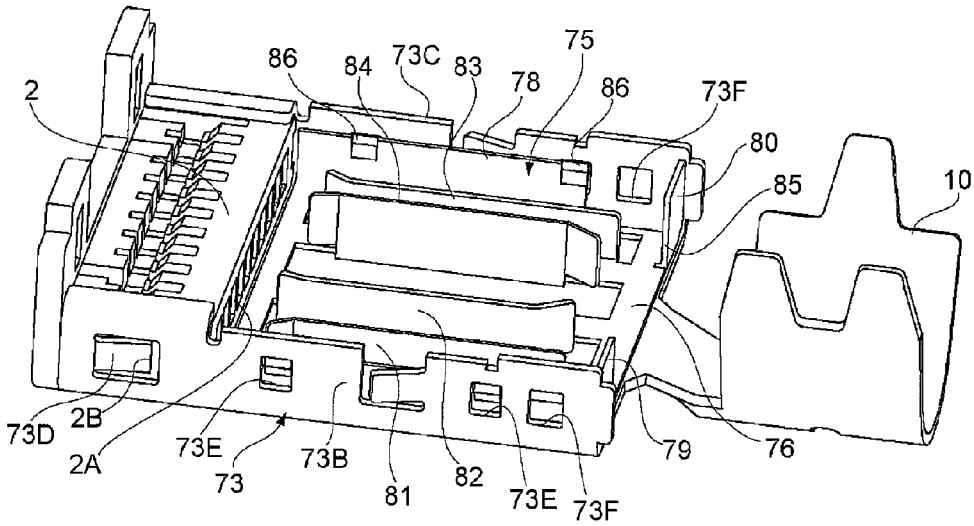
FIG. 17 is a perspective view of the electrical connector according to the seventh embodiment of the invention, which shows a base portion, connector main body, a cable holding portion, etc.
Figure 18:
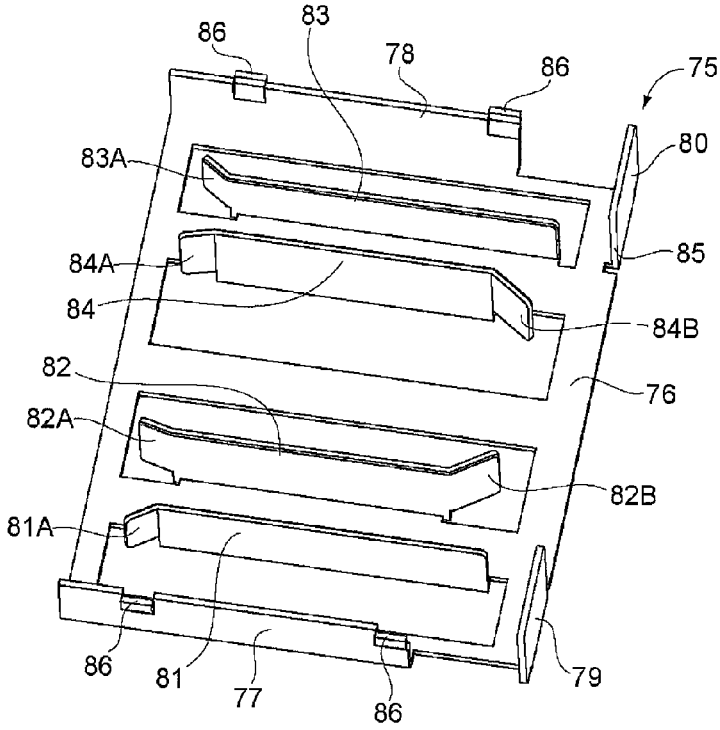
FIG. 18 is a perspective view of the cable holding portion in the electrical connector according to the seventh embodiment of the invention.
Figure 19:
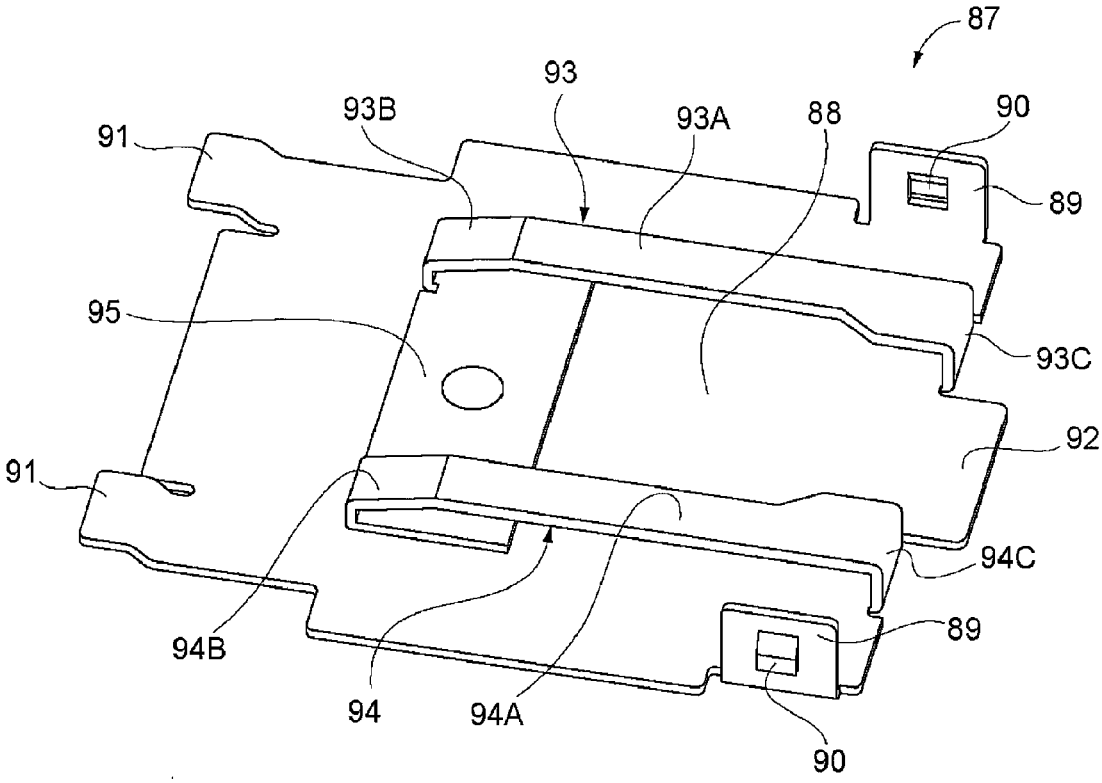
FIG. 19 is a perspective view of the electrical connector according to the seventh embodiment of the invention, which shows a lower face of a shell cover portion.

FIGS. 15 and 16 show an electrical connector according to the seventh embodiment of the invention. FIG. 17 shows a base portion, a connector main body, and a cable holding portion, etc. of the electrical connector; FIG. 18 shows the cable holding portion of the electrical connector; and FIG. 19 shows a lower face of the shell cover portion of the electrical connector. Here, in FIGS. 15 through 19, the same reference numerals are used for the same elements as those in the electrical connector 1 according to the first embodiment, and the explanation will be omitted. In addition, illustration of the shielded twisted pair cable is omitted in FIGS. 15 through 19.

In FIG. 15, the electrical connector 71 according to the seventh embodiment of the invention, similarly to the electrical connector 1 of the first embodiment of the invention, is an electrical connector to connect to an end portion of the shielded twisted pair cable 101 (see FIGS. 8 and 9) having two twisted wire pairs. The electrical connector 71 generally includes the connector main body 2, the shell member 72, and the cable fastening securing section 10.

Similarly to the shell member 3 of the electrical connector 1 according to the first embodiment, the shell member 72 is a member to hold the connector main body 2 and an end portion of the shielded twisted pair cable 101. As shown in FIG. 16, the shell member 72 includes a base portion 73, a cable holding portion 75, and a shell cover portion 87.

The base portion 73 is made of a conductive material such as copper alloy. As shown in FIG. 16, the base portion 73 is formed to have a lateral cross-section of square-bottomed U shape that opens upward by bending two end portions of a quadrangle sheet metal, and has a bottom plate portion 73A that forms a bottom plate of the base portion 73, and a pair of side wall plate sections 73B and 73C that form lateral walls of the base portion 73.

In addition, the connector main body 2 is disposed between the side plate portion 73B and the side plate portion 73C on the bottom plate portion 73A that is provided on a front end side of the base portion 73. On the other hand, the cable holding portion 75 is disposed on the bottom plate portion 73A that is provided on a basal end side of the base portion 73.

Furthermore, latching protrusions 73D (only one of them is illustrated in the figure) are respectively formed on the side plate portions 73B and 73C of the base portion 73 to catch the connector main body 2 so as to secure the connector main body 2 to the base portion 73. Each latching protrusion 73D engages with an engaging recess 2B formed on the side face of the connector main body 2. In addition, on the side plate portions 73B and 73C of the base portion 73, there are latching holes 73E respectively formed to catch the cable holding portion 75 so as to secure the cable holding portion 75 onto the base portion 73. Two latching holes 73E are formed on the side plate portion 73B and another two are formed on the side plate portion 73C. Each latching hole 73E engages with a latching protrusion 86 of the shell cover portion 87.

Here, a latching mechanism to latch the cable holding portion 75 to the base portion 73 does not have to be the latching holes 73 and may be recesses. Alternatively, it is also possible to form protrusions on the side plate portions 73B and 73C and form holes or recesses on the cable holding portion 75. This would be similarly applied also to a latching mechanism to latch the shell cover portion 87 to the base portion 73 and a latching mechanism 73 to latch the connector main body 2 to the base portion 73.

The cable holding portion 75 is a member to hold each untwisted portion 106 of the shielded twisted pair cable 101 on a basal end side of the base portion 73 (see FIG. 9). As shown in FIG. 17, the cable holding portion 75 is disposed between the side plate portions 73B and 73C on the bottom plate portion 73A of the base portion 73 on the basal end side of the base portion 73. The cable holding portion 75 in the embodiment holds two untwisted portions 106 that respectively correspond to two wire pairs of the shielded twisted pair cable 101 while keeping them away from each other in the width direction of the base portion 4. The cable holding portion 75 is made of the same conductive material as that of the base portion 73.

As shown in FIG. 18, the cable holding portion 75 has a substrate section 76, a pair of lateral side wall sections 77 and 78, basal-end side wall sections 70 and 80 that are divided into two sections, two pairs of divided wall sections 81, 82, 83, and 84. The substrate section 76, lateral side wall sections 77 and 78, basal end side wall sections 79 and 80, and separation wall portions 81, 82, 83, and 84 are formed, for example, by bending sheet material that is formed to have a specific shape.

The substrate section 76 is mounted on the bottom plate portion 73A of the base portion 73. The lateral side wall sections 77 and 78 overlap with side plate portions 73B and 73C of the base portion 73 respectively, when the substrate section 76 is mounted on the bottom plate portion 73A of the base portion 73. The basal end side wall sections 79 and 80 become a wall on the basal end side of the shell member 72 when the substrate section 76 is mounted on the bottom plate portion 73A of the base portion 73 and an insertion hole 85 becomes formed between the basal end side wall section 79 and the basal end side wall section 80 to insert an end section of the shielded twisted pair cable 101 therethrough.

As shown in FIG. 17, a pair of dividing walls 81 and 82 rises from the bottom plate portion 73A of the base portion 73 and extends from a basal end side of the base portion 73 so as to reach the connector main body 2 or to a position that is close threreto while being parallel to each other. In addition, the respective separation wall portions 81 and 82 extend upward so as to contact with or get close to a lower face of the cover plate section 88 of the shell cover portion 87 attached on the base portion 73.

A pair of single wires 102 of one untwisted portion 106 of the shielded twisted pair cable 101 is held between the separation wall portion 81 and the separation wall portion 82 while positioning the pair of single wires 102 to be parallel to each other and get close or contact to each other. The distance between the separation wall portion 81 and the separation wall portion 82 (distance between the separation wall portions 81 and 82 where the separation wall portions extend being parallel to each other) is almost two times of diameter of the single wire 102 of the shielded twisted pair cable 101, and a pair of single wires 102 of one untwisted portion 106 of the shielded twisted pair cable 101 is set to just fit in between the separation wall portion 81 and the separation wall portion 82 while being positioned as described above. With the configuration, it is possible to securely hold the pair of single wires 102 between the separation wall portion 81 and the separation wall portion 82 while being positioned and prevent displacement of the both single wires 102.

The respective separation wall portions 81 and 82 have slope sections 81A and 82A, which are bent so as to be away from each other in the width direction and are sloped so as to have longer distance between the separation wall portion 81 and the separation wall portion 82, at an end section that faces front end side of the base portion 71. With the slope sections 81A and 82A, it is possible to gradually flex each single wire 102 upon introducing a pair of single wires 102, which is attached to an attachment port 2A of the connector main body 2, from the attachment port 2A in between the separation wall portions 81 and 82, and it is possible to prevent application of large bending force to each single wire 102.

On the other hand, an end section of the separation wall portion 82, which faces the basal end side of the base portion 73, has a slope section 82B formed being bent to be away from the separation wall portion 81 in the width direction and being sloped to get close to a center part in the width direction on the basal end side of the base portion 73. With the slope section 82B, it is possible to gradually flex each single wire 102 upon introducing a pair of single wires 102, which is held between the separation wall portions 81 and 82, to the insertion hole 85, and it is possible to prevent application of large bending force to each single wire 102.

A pair of separation wall portions 83 and 84 is also formed similarly to the separation wall portions 81 and 82. A pair of single wires 102 of the other untwisted portion 106 of the shielded twisted pair cable 101 is held between the separation wall portion 83 and the separation wall portion 84 while the pair of single wires 102 is positioned so as to be parallel to each other and get close or contact to each other. In addition, the separation wall portions 83 and 84 also have slope sections 83A, 84A, and 84B that are formed similarly to the slope sections 81A, 82A, and 82B of the separation wall portions 81 and 82.

In addition, the lateral side wall sections 77 and 78 have latching protrusions 86 that are formed to position the cable holding portion 75 on the bottom plate portion 73A of the base portion 73 and to latch and secure the cable holding portion 75 to the base portion 73. Two latching protrusions 86 are formed on the lateral side wall section 77 and another two are formed on the lateral side wall section 78 so as to correspond to the latching holes 73E formed on the side plate portions 73B and 73C of the base portion 73. The latching protrusions 86 respectively engage to the latching holes 73. By forming the latching protrusions 86 and the latching holes 73E as described above, it is possible to easily and precisely position and secure the cable holding portion 75 onto the base portion 73 and thereby attain easier and more efficient assembling work of the electrical connector 71.

As shown in FIG. 15, the shell cover portion 87 is a member to fully cover the connector main body 2 and an end portion of the shielded twisted pair cable 101, which are disposed on the base portion 73, from thereabove. The shell cover portion 87 is provided on the base portion 73 so as to position the connector main body 2, the cable holding portion 75, and an end portion of the shielded twisted pair cable 101 including each untwisted section 106 between the shell cover 87 and the base portion 73.

The shell cover portion 87 has a flat cover plate section 88, which is made of, for example, the same conductive material as that of the base portion 73. When the shell cover portion 87 is attached to the base portion 73, the base portion 73 is fully covered by the cover plate section 88. At this time, the spaces between the separation wall portions 81 and 82 and between the separation wall portions 83 and 84 of the cable holding portion 75 provided on the bottom plate portion 73A of the base portion 73 are also fully covered by the cover plate section 88 from thereabove.

In addition, as described above, support sections 89, which protrude downward, are respectively provided on both sides of the cover plate section 88 in the width direction. Each support section 89 is formed by bending a sheet material that forms the cover plate section 88. Furthermore, each support section 89 has a latching protrusion 90 formed. Moreover, a pair of projecting sections 91 is formed on a front end side of the cover plate section 88.

As shown in FIGS. 15 and 16, by inserting each projecting section 91 into a groove section (not illustrated) formed on the connector main body 2 secured on the base portion 73 and engaging each latching protrusion 90 to latching hole 73F formed on the side plate portions 73B and 73C of the base portion 73, it is possible to secure the shell cover portion 87 to the base portion 73. In addition, there is a projecting section 92 formed on a basal end side of the cover plate section 88. Upon dissembling the electrical connector 71, by hooking a tool or finger onto the projecting section 92, it is possible to detach the shell cover portion 87 from the base portion 73.

As shown in FIG. 19, the shell cover portion 87 has a pair of inner lid sections 93 and 94. Each inner lid section 93 and 94 is made of, for example, the same conductive material as that of the cover plate section 88, and disposed on a lower face of the cover plate section 88. For example, each inner lid section 93 or 94 is formed by bending a sheet material that forms the cover plate section 88 and then making face-contact to a joining section 95 formed at a front end portion of the inner lid sections 93 and 94 onto a lower surface of the cover plate section 88.

The inner lid section 93 is disposed to positions that correspond to the separation wall portions 81 and 82 of the cable holding portion 75 disposed on the bottom plate portion 73A of the base portion 73, and the inner lid section 94 is provided at positions that correspond to the separation wall portions 83 and 84 of the cable holding portion 75 disposed on the bottom plate portion 73A of the base portion 73.

The inner lid section 93 has a cover face 93A that protrudes downward from a lower face of the cover plate section 88 and extends parallel to the lower face of the cover plate section 88 at a position being away from the lower face of the cover plate section 88. As shown in FIG. 15, upon attaching the shell cover portion 87 onto the base portion 73, the inner lid section 93 goes inside between the separation wall portions 81 and 82, and fully covers the untwisted portion 106 held between the separation wall portions 81 and 82 inside between the separation wall portions 81 and 82 of the cover face 93A.

Here, the inner lid section 93 extends from the basal end section of the base portion 73 to a position reaching or getting close to the connector main body 2. In addition, an end face 93C of the basal end section of the inner lid section 93 is almost the same face as an outer face on the basal end side of the basal end side wall sections 79 and 80 that form the wall on the basal end side of the shell member 72.

In addition, the width dimension of the inner lid section 93 is almost the same as that between the separation wall portion 81 and the separation wall portion 82. With the configuration, almost whole part of the untwisted portion 106 held between the separation wall portions 81 and 82 is fully covered by the inner lid section 93 in the length direction and also in the circumferential direction.

Furthermore, the inner lid section 93 has a fixed-fixed beam structure in which only two parts, i.e. the frontal end portion and a basal end portion, are supported by a lower face of the cover plate section 88. With the configuration, it is possible to apply a suitable amount of pressing force to the untwisted portion 106 held between the separation wall portions 81 and 82 from thereabove by the inner lid section 93, and it is possible to press the untwisted portion 106 thereto while being positioned as described above.

In addition, the inner lid section 93 has a slope section 93B formed at an end portion that faces a front end side of the base portion 73, which is sloped so as to gradually get close to a lower face of the cover plate section 88 towards the front end side of the cover plate section 88. With the slope section 93B, it is possible to prevent application of excess pressing force from thereabove to each single wire 102 guided from the attachment port 2A of the connector main body 2 to between the separation wall portions 81 and 82.

Moreover, the inner lid section 94 is formed similarly to the inner lid section 93. As shown in FIG. 15, when the shell cover portion 87 is attached onto the base portion 73, the inner lid section 94 goes inside between the separation wall portions 83 and 84, and fully covers almost whole of the untwisted portion 106 in the length direction and also in the circumferential direction, which is held between the separation wall portions 83 and 84, inside between the separation wall portions 81 and 82 of the cover face 93A.

Furthermore, the inner lid section 94 has a fixed-fixed beam structure similarly to the inner lid section 93, and thereby it is possible to apply a suitable amount of pressing force by elastic force to the untwisted portion 106 held between the separation wall portions 83 and 84 from thereabove by the inner lid section 94, and it is possible to press the untwisted portion 106 thereto while being positioned as described above. In addition, the inner lid section 94 has a slope section 94B similarly to the slope section 93B of the inner lid section 93, and thereby it is possible to prevent application of excess pressing force to each single wire 102 guided from the attachment port 2A of the connector main body 2 to between the separation wall portions 83 and 84.

A method of connecting the electrical connector 71 configured as described above to an end portion of the shielded twisted pair cable 101 is as follows. As shown in FIG. 9, an insulating shield 105 is removed at an end portion of the shielded twisted pair cable 101 and the conductive shield 104 is folded outside and each conductive coating film 107 is removed. Then, two pairs of single wires 102 are respectively untwisted, and the insulator 102B is removed at an end portion of each single wire 102 so as to expose the end portion of the conductor 102A.

Subsequently, two pairs of single wires 102 are respectively untwisted and the insulator 102B is removed at an end portion of each single wire 102 so as to expose an end portion of the conductor 102A. Then, the connecting terminal 12 (see FIG. 12) is crimped to the exposed end of the conductor 102A of each single wire 102, and an end portion of the conductor 102A of each single wire 102 crimped to the connecting terminal 12 is attached to the attachment port 2A of the connector main body 2, which is not attached to the base portion 73.

Then, the cable holding portion 75 is attached to a basal end side of the base portion 73. With the procedure, the cable holding portion 75 and the base portion 73 are electrically connected. Subsequently, the connector main body 2 is attached to a front end side of the base portion 73 and two untwisted portions 106 of the shielded twisted pair cable 101 attached to the connector main body 2 are respectively disposed between the separation wall portions 81 and 82 and between the separation wall portions 83 and 84, and are positioned so that a pair of single wires 102 of each untwisted portion 106 is parallel to each other and contacts or gets close to each other and organized.

Next, the shell cover portion 87 is attached onto the base portion 73. With the operation, the inner lid section 93 goes in between the separation wall portions 81 and 82, and fully covers one untwisted portion 106 disposed between the separation wall portions 81 and 82 from thereabove and presses thereto. In addition, the inner lid section 94 goes in between the separation wall portions 83 and 84 and fully covers the other untwisted portion 106 disposed between the separation wall portions 83 and 84 from thereabove and presses thereto. Furthermore, the cover plate section 88 fully covers the connector main body 2, the cable holding portion 75, and an end of the shielded twisted pair cable 101 from thereabove. In addition, the shell cover portion 87 and the base portion are electrically connected.

Then, the shielded twisted pair cable 101 is fastened to be secured onto the cable fastening securing section 10. At this time, contacting the conductive shield 104 that is folded back to the cable fastening securing section 10, the conductive shield 104 and the cable fastening securing section 10 are electrically connected. With the operation, the conductive shield 104 and the base portion 73 are electrically connected. With above operations, connection of the electrical connector 1 to an end portion of the shielded twisted pair cable 101 completes.

As described above, according to the electrical connector 71 of the seventh embodiment, it is possible to fully cover the whole of each untwisted portion 106 of the shielded twisted pair cable 101 in the length direction and the circumferential direction by the separation wall portions 81, 82, 83, and 84 of the cable holding portion 75, the substrate section 76 of the cable holding portion 75, and the inner lid sections 93 and 94 of the shell cover portion 87, any of which is made of a conductive material. Furthermore, it is possible to fully cover whole of each untwisted portion 106 from the outer circumferential side by the side plate portions 73B and 73C, the bottom plate portion 73A of the base portion 73, and the cover plate section 88 of the shell cover portion 87, any of which is made of a conductive material.

With the operation as described above, since it is possible to fully cover the whole of each untwisted portion 106 doubly by a conductive material, it is possible to significantly enhance the shielding performance of each untwisted portion 106. Therefore, it is possible to reduce impedance at each untwisted portion 106 and it is possible to securely match impedance between circuits or devices that are connected via the electrical connector 71 and the shielded twisted pair cable 101.

Furthermore, according to the electrical connector 71 of the seventh embodiment, it is possible to form the cable holding portion 75 as a single member having the substrate section 76 and the separation wall portions 81, 82, 83, and 84, and thereby improve the assembling work efficiency of the electrical connector 71.

Here, the aforementioned first through fifth and the seventh embodiments describe the electrical connectors 1, 21, 31, 41, 51, and 71 to connect to the shielded twisted pair cable 101 having two sets of paired wires as an example. However, the invention is not limited to those and is applicable to an electrical connector to connect to a shielded twisted pair cable having one set or at least three sets of paired wires.

In addition, in each embodiment described above, the electrical connectors 1, 21, 31, 41, 51, 61, and 71 to connect to a shielded twisted pair cable 101 are described as an example, but the invention is not limited to those and also applicable to an electrical connector to connect to an unshielded twisted pair cable.

Moreover, the aforementioned first through the sixth embodiments describe a case of continuously covering almost whole of the untwisted portion 106 in the length direction by a conductive member, such as a lanced section and cable cover member. It is preferred to continuously cover almost whole untwisted portion 106 in the length direction since it is possible to enhance the effect of controlling reduction of the noise performance. However, it is also possible to obtain some effects also by a configuration that intermittently covers a part or almost whole of the untwisted portion 106 in the length direction, and it is possible to apply such configuration depending on uses of the electrical connector.

Furthermore, it should be understood that the invention may be altered, modified, or changed within scope of the invention that can be inferred from the claims and the whole picture of the specification and the invention also encompasses such modified electrical connector and a method of connecting a twisted pair cable and an electrical connector.

The disclosure of Japanese Patent Application No. 2010-220633, filed on Sep. 30, 2010 is incorporated in the application by reference.

While the invention has been explained with reference to the specific embodiments of the invention, the explanation is illustrative and the invention is limited only by the appended claims.

What is claimed is:

1. An electrical connector to be connected to a twisted pair cable having a pair of single wires and a conductive shield, comprising:

a connector main body portion for connecting to end portions of the single wires in an untwisted state; and a shell member attached to the connector main body portion for holding the single wires at an untwisted portion thereof, said shell member including a base portion, a cable holding portion, and a cover portion, said base portion having a base end portion on a side of the connector main body portion and a distal end portion on a side of the untwisted portion, said cable holding portion being provided for holding the single wires arranged in parallel to each other in a state that the single wires are situated adjacently or contact with each other, said cover portion being situated above the base portion so that at least the untwisted portion and the cable holding portion are situated between the base portion and the cover portion, wherein said base portion includes a bottom plate portion and a pair of side plate portions, said cable holding portion includes a pair of separation wall portions arranged between the side plate portions and extending in parallel to each other from the base end portion toward the connector main body portion for holding the untwisted portion, said cable holding portion further includes a cable cover member for covering the untwisted portion between the cable cover member and the base portion, said cable cover member includes a ceiling plate section and a bent section so that the bent section is accommodated between the separation wall portions along the untwisted portion, and said cover portion is formed in a late shape for covering the separation wall portions.

2. The electrical connector according to claim 1, wherein said cable holding portion is arranged to collectively cover an entire portion or a part of circumferences of the single wires.

3. The electrical connector according to claim 1, wherein said cable holding portion is arranged to continuously cover the single wires from the base end portion to the connector main body portion or near the connector main body portion.

4. The electrical connector according to claim 1, wherein said cable cover member is formed of a conductive member attached to the base portion.

5. The connector according to claim 4, wherein said base portion includes at least a pair of protruding portions at the base end portion on both sides of the untwisted portion for positioning the single wires on the base portion, said conductive member being arranged to bridge between the protruding portions.

6. The connector according to claim 4, wherein said cover portion includes a pressing member for pressing the conductive member between the cover portion and the base portion.

7. The connector according to claim 1, wherein said cable holding portion is formed of a bent portion cut in the base portion.

8. The connector according to claim 1, wherein said cover portion is formed of a conductive material, said cable holding portion being arranged to cover at lease an upper portion of the untwisted portion.

9. The connector according to claim 1, wherein said cable holding portion is arranged at a plurality of locations.

10. An electrical connector to be connected to a twisted pair cable having a pair of single wires and a conductive shield, comprising:

a connector main body portion for connecting to end portions of the single wires in an untwisted state; and a shell member attached to the connector main body portion for holding the single wires at an untwisted portion thereof, said shell member including a base portion, a cable holding portion, and a cover portion, said base portion having a base end portion on a side of the connector main body portion and a distal end portion on a side of the untwisted portion, said cable holding portion being provided for holding the single wires arranged in parallel to each other in a state that the single wires are situated adjacently or contact with each other, said cover portion being situated above the base portion so that at least the untwisted portion and the cable holding portion are situated between the base portion and the cover portion, wherein said base portion includes a bottom plate portion and a pair of side plate portions, said cable holding portion including a pair of separation wall portions arranged between the side plate portions and extending in parallel to each other from the base end portion toward the connector main body portion for holding the untwisted portion, said cover portion being formed in a plate shape for covering the separation wall portions, and said cover portion includes a cover plate section and an inner lid portion extending from the cover plate section, said inner lid portion being situated between the cover plate section and the base portion with a specific distance in between.

11. The connector according to claim 10, wherein said cable holding portion includes a base plate portion arranged on the bottom plate portion, said separation wall portions being arranged on the base plate portion.

12. The connector according to claim 11, wherein said cable holding portion includes an engaging portion for engaging the base portion and positioning the base plate portion and the separation wall portions on the bottom plate portion.

13. The connector according to claim 10, wherein said pair of separation wall portions is disposed at a plurality of locations.

14. The connector according to claim 1, further comprising a conductive shield connection portion disposed at the base end portion for electrically connecting the conductive shield of the twisted pair cable to the base portion.

15. A method of connecting a twisted pair cable to an electrical connector, comprising the steps of:

untwisting a pair of single wires of the twisted pair cable to form an untwisted portion;

attaching an end of the single wire to a connector main body of the electrical connector;

arranging the single wires in parallel to each other on a base portion on a base end portion thereof in a state that the single wires are situated adjacently or contact with each other;

holding the single wires with a cable holding portion on the base end portion so that a bent section of the cable holding portion is accommodated between separation wall portions of the cable holding portion along the untwisted portion; and attaching a cover portion to the base portion so that at least the untwisted portion and the cable holding portion are situated between the base portion and the cover portion.

* * * * *